US005421676A

United States Patent [19]

Wybro et al.

[11] Patent Number: 5,421,676

[45] Date of Patent: Jun. 6, 1995

[54] TENSION LEG PLATFORM AND METHOD OF INSTALATION THEREFOR

[75] Inventors: Pieter G. Wybro; David N. Dunlop, both of Houston, Tex.

[73] Assignee: Sea Engineering Associates, Inc., Houston, Tex.

[21] Appl. No.: 14,690

[22] Filed: Feb. 8, 1993

[51] Int. Cl.[6] ..... B63B 35/44; E02B 17/00

[52] U.S. Cl. ..... 405/223.1; 405/204; 405/209; 405/224

[58] Field of Search ..... 405/224, 223.1, 202, 405/195.1, 203, 204; 114/264, 265

[56] References Cited

U.S. PATENT DOCUMENTS

| | | | |
|---|---|---|---|
| 3,577,946 | 5/1971 | Horton | 405/223.1 X |
| 3,982,401 | 9/1976 | Loggins | 405/224 X |
| 3,983,706 | 10/1976 | Kalinowski | 405/223.1 X |
| 4,473,323 | 9/1984 | Gregory | 405/224 |
| 4,626,136 | 12/1986 | Gunderson | 405/224 |
| 4,626,137 | 12/1986 | Willemsz | 405/224 |
| 4,685,833 | 8/1987 | Iwamoto | 405/224 X |
| 4,702,321 | 10/1987 | Horton | 405/224 X |
| 4,702,648 | 10/1987 | Stageboe et al. | 405/224 |
| 4,784,529 | 11/1988 | Hunter | 405/224 X |
| 4,844,660 | 7/1989 | Ortemond | 405/224 |
| 4,861,196 | 8/1989 | Folse | 405/224 |
| 4,895,481 | 1/1990 | Pepin-Lehalleur et al. | 405/223.1 X |
| 4,906,139 | 3/1990 | Chiu et al. | 405/223.1 |
| 5,150,987 | 9/1992 | White et al. | 405/224 |
| 5,324,141 | 6/1994 | Hunter et al. | 405/223.1 |

FOREIGN PATENT DOCUMENTS

| | | | |
|---|---|---|---|
| 2018871 | 10/1979 | United Kingdom | 405/224 |

OTHER PUBLICATIONS

New Concept: Dynamic Mooring-Positioning System for Fixed, Compliant Modes for Platform; Ocean Industry, Mar. 1976 pp. 67-69.

*Primary Examiner*—Dennis L. Taylor
*Attorney, Agent, or Firm*—Kenneth A. Roddy

[57] ABSTRACT

A compact offshore tension leg platform having a deck, a hull, and a plurality of elongate tendons securing the hull to an ocean floor foundation provides full well workover and production capabilities for autonomous operation and can be installed and operated in any waterdepth and sustain any environmental loading conditions. The hull supports the well risers of well trees located below the water surface at an elevation in close proximity to the connections of the tendons to the hull. Alternatively the risers and trees may be supported by the deck. A well workover platform, supported by a circular perimeter trackway on the deck may be positioned over any of the well risers for workover operations. Liquid products may be exported from the platform via a seabed pipeline or to a floating tanker moored to a mobile offtake on the deck support column. The hull is configured to minimize loadings in the tendons. All components, except the deck, are installed by a drilling vessel without the need for specialist installation vessels and equipment. The tendons are arranged in groups offset from the hull body to resist platform overturning loadings, and to reduce the tendons pretension required to prevent platform pitch and roll motions. The wells are drilled prior to installation of the hull using a drilling vessel. After installation of the platform, all operations required on the wells are performed autonomously from the platform without the need for another drilling vessel or equipment.

15 Claims, 36 Drawing Sheets

GM EFFECT OF GUIDEWIRES :

$$\delta = L \sin \phi$$

RESTORING MOMENT = $F_\delta \times L$ (DUE TO SUBMERGED VOLUME) = $\rho g \delta \times L \times Awp$ $= \rho g L^2 \sin \phi \times Awp$

TOTAL RESTORING MOMENT :

$$M_R = [W\overline{GM} + \rho g L^2 Awp] \sin\phi = W[\overline{GM} + \Delta\overline{GM}] \sin \phi$$

$$\text{OR } \Delta\overline{GM} = \frac{\rho g \, Awp \, L^2}{W}$$

TENSION LEG PLATFORM AND METHOD OF INSTALATION THEREFOR

BACKGROUND OF THE INVENTION

1. Field of the Invention

This invention relates generally to tension leg platforms, and more particularly to a compact offshore tension leg platform (TLP) and a method for installing the same at a deepwater location.

2. Brief Description of the Prior Art

In the past, tension leg platforms (TLP's) have been designed to include the capability of performing well drilling operations. Furthermore, these platforms have supported the risers and well trees at the deck level. To meet these requirements, the platforms have to be large enough to provide buoyancy to support the payload of the well drilling equipment and the risers support system has to incorporate mechanisms which ensure the tension in each riser remains constant as the length of the risers varies due to movements of the hull caused by wave and environmental loadings. The size and complexity of these TLP's have resulted in costs which are too high for the commercial development of small offshore hydrocarbon reservoirs.

In the search for a means of producing from small reservoirs, various small TLP configurations have been proposed. TLP's without any drilling capability have been proposed. All production drilling activities have to be performed by a drilling vessel positioned alongside or over the TLP. The purpose of these platforms has been only to support the risers and position the well trees above the water surface. Production equipment and facilities have been provided on the separate drilling and support vessel.

Other proposed small TLP's have included the provision of production facilities. However, no capability for drilling operations has been included. In summary, all the proposed small TLP's have a requirement for a separate vessel in order that operations can be performed on the wells during the phase of producing from the reservoir.

The present invention provides all drilling capabilities needs for production well completions, re-completions, workover and fluid injection operations. The technical complexity of the large TLP's is, however, avoided by minimizing the above water payload. Moreover the novel hydrodynamic configuration of the platform hull reduces the hull motion responses to wave and current loadings and thereby reduces the loadings in the anchored tendons. Furthermore, if adopted, the placement of the well trees below the water surface simplifies the risers support mechanisms. Installation of the foundations, tendons and hull does not require a specialist deepwater cranevessel and equipment.

The present platform may be used not only for production from small deepwater offshore reservoirs but also, by installing multiple platforms in accordance with the present invention allows a phased development of and production from large reservoirs.

It is therefore a general object of the present invention to provide an offshore tension leg platform and method of installation which will obviate or minimize the complexities and overcome the limitations of conventional tension leg platforms thereby reducing the cost of the platform and of producing from small offshore reservoirs.

It is another object of the present invention to provide a seabed structure which will position the wells and anchor piles in a desired arrangement that may be installed by a conventional deepwater drilling vessel and using normal drilling equipment, and does not constitute an integral part of the installed platform structure.

It is another object of the present invention to provide an offshore tension leg platform wherein the foundation anchor piles are installed using conventional drilling techniques and each tendon is connected to a designated pile, and the anchor piles may be installed prior to, during or after the operations of drilling the production wells.

It is another object of the present invention to provide an offshore tension leg platform wherein the tendons may be manufactured using standard oil industry drilling materials and components and may be assembled and installed by a conventional deepwater drilling vessel.

It is another object of this invention to provide an offshore tension leg platform wherein each tendon is connected to a foundation pile using a conventional flex joint tubular of varying diameter and thickness and the tendon and pile may be varying diameter and thickness and the tendon and pile may be assembled and installed as a single unit and all the platform tendons are installed, connected to the foundation anchor piles before the hull structure is towed to the site.

It is another object of this invention to provide an offshore tension leg platform having a hull structure that is hydrodynamically configured to minimize the magnitude of and the variation of the loadings in the tendons, thereby minimizing the size and complexity of the anchor piles, the connections between the piles and tendons, the tendon bodies and the connections of the tendons to the platform hull.

It is another object of this invention to provide an offshore tension leg platform having a hull structure sufficiently small and simple such that it may be manufactured by the majority of the fabrication facilities which provide such services to the offshore energy industry, and which may be towed, floating, by a conventional towing vessel from the site of manufacture to the offshore designated platform location and connected to the tendons without any need for auxiliary buoyancy elements or cranevessel lifting assistance, and wherein connection of the hull to the tendons is performed simultaneously on the full complement of tendons without the need for complex tensioning devices, slipnuts and other mechanisms.

Another object of this invention is to provide an offshore tension leg platform which supports the well risers of well trees located below the water surface near the keel of the hull at an elevation close to that of the tendon upper connections wherein the means of support is maintenance free and devoid of any hydraulic or hydropneumatic mechanisms, and the well trees have conventional above-water surface components and are devoid of complex fixtures and controls used for conventional subsea trees.

Still another object of this invention is to provide an offshore tension leg platform wherein the platform above surface equipment and facilities are capable of all production operations, with the exception of actual drilling of the wells, autonomously and without the need for supplementary vessels and equipment, and if so desired, may have equipment and facilities which permit the transfer of fluid products to a floating tanker vessel for exportation from the site, or by means of a conventional pipeline, and may be equipped with a means of mooring the tanker, if such means is used.

It is a further object of this invention to provide an offshore tension leg platform wherein the major portion of the platform components may be used again at a different site, including the deck, all equipment there on, the hull, the risers and well trees, and the tendons.

BRIEF SUMMARY OF A PREFERRED EMBODIMENT OF THE INVENTION

A preferred embodiment of the invention, which is intended to accomplish all the foregoing objects, entails a small tension leg platform which is manufactured using existing materials, components and technology already used in the offshore industry and which largely may be installed using a conventional deepwater drilling vessel. A conventional cranevessel is used to install the deck structure, fully equipped, by lifting the single unit and setting it onto the hull structure, after said hull has been connected to the tendons.

A template structure manufactured using steel plate and tubulars is installed on the seabed. This serves to position the required number of wells and anchor piles in their desired positions. The wells and anchor piles, when completed, are supported by the subsoil alone, there being no requirement for permanent support by the template. The template structure is devoid of any mechanisms for adjustment of elevation or horizontal trim. Two alternative means of supporting the structure exist. For seabed soil conditions which are suitable, the template is supported by the seabed surface. Areas of steel plate panels are provided to distribute the payload of the template over the seabed. When the load carrying capacity of the seabed is insufficient or surface is irregular, piles are provided to support the template structure independent of the seabed surface. A steel frame is placed on the seabed. This serves to position the support steel tubular piles as desired. The frame and piles are installed using a drilling vessel and conventional drilling equipment and practices. The same vessel is then used to lower and emplace the template structure onto the support piles.

A tubular steel foundation anchor pile is provided for each of the platform tendons. These piles are installed using traditional drilling practices.

A desired number of tendons are provided to connect the hull to the foundation anchor piles. The main body of the tendon comprises standard drilling riser pipe sections which are assembled at site by a drilling vessel using conventional equipment and practices. The lower extremity of the tendon is connected to the anchor pile with a metal flex joint section similar to those used for marine riser applications. The tendon connection to the hull structure consists of a short tubular steel pipe section which is attached to the main tendon body with a cardan joint, which provides omnidirectional rotational freedom of the tendon with respect to the hull, the cardan joint incorporating two hinge pins with rotational axes at right angles and being used for vehicle drive train applications and offshore oil industry structures which require a means of articulation and the cardan joint being preferred since it facilitates future disconnection of the tendons from the hull. Alternatively a flex joint as used at the bottom connection may also be used at the top tendon connection. The upper pipe section is inserted into a corresponding pipe sleeve of larger diameter which is attached near the base of the hull by steel bracing members. Cement grout pumped into the annulus between the connecting tendon pipe and the hull sleeve pipe provides a permanent connection of the tendon to the hull.

A drilling vessel is used to assemble and deploy each anchor pile and tendon assembly vertically from the rig. All the tendons are installed, anchored by the foundation piles, before the hull structure is towed to the site. Temporary buoyancy units are provided and attached to the tendons near the upper extremity. These provide an upward force on the tendon and maintain it stable, in tension and vertical, when not subjected to horizontal environmental loadings.

The hull is positioned, floating directly above the installed tendons by a combination of mooring lines from the drilling vessel and towlines attached to assisting tugboats. Temporary winch controlled tension lines are connected to each of the tendon upper extremities and the hull is then ballasted with water so that the connection sleeves engage over the tendon tops. The water ballast is increased until the desired draft is reached, and when the tendon connectors are each inserted inside the respective hull connection sleeves. Means are provided on each connection sleeve to prevent relative movement of the hull and the tendons during the placement and curing of the permanent cement grout connection material, said mean being mechanical gripper units which when actuated engage upon the tension line such that the hull is permitted to travel downward with respect to the tension line but is restrained from upward relative vertical movement.

The hull upper section comprises a single long vertical cylindrical column which passes through the water surface, up to an elevation above the general height of waves. The platform deck structure has a corresponding support column section, having identical diameter to that of the hull above water column. The complete equipped deck is lifted by a conventional crane vessel off a cargo barge and placed onto the hull column. The joint of the hull and deck column is then welded for a permanent structural connection of the deck to the hull structure.

In close proximity to the keel of the hull structure and around the perimeter of the hull, supports are provided for the production wells risers and trees. Each well is tied back to the platform hull using the mobile well workover platform. This is positioned over a well, and using conventional drilling procedures, the riser pipe is assembled, deployed to the seabed and connected to the seabed wellhead. The hull riser support incorporates a means of maintaining the riser tension within desired limits which prevents buckling or damage to the riser during the operating life of the platform.

BRIEF DESCRIPTION OF THE DRAWINGS

Other objects and advantages of the present invention will become apparent from the following detailed description of preferred embodiments thereof taken in conjunction with the accompanying drawings.

DETAILED DESCRIPTION OF A PREFERRED EMBODIMENT

Figure 1:
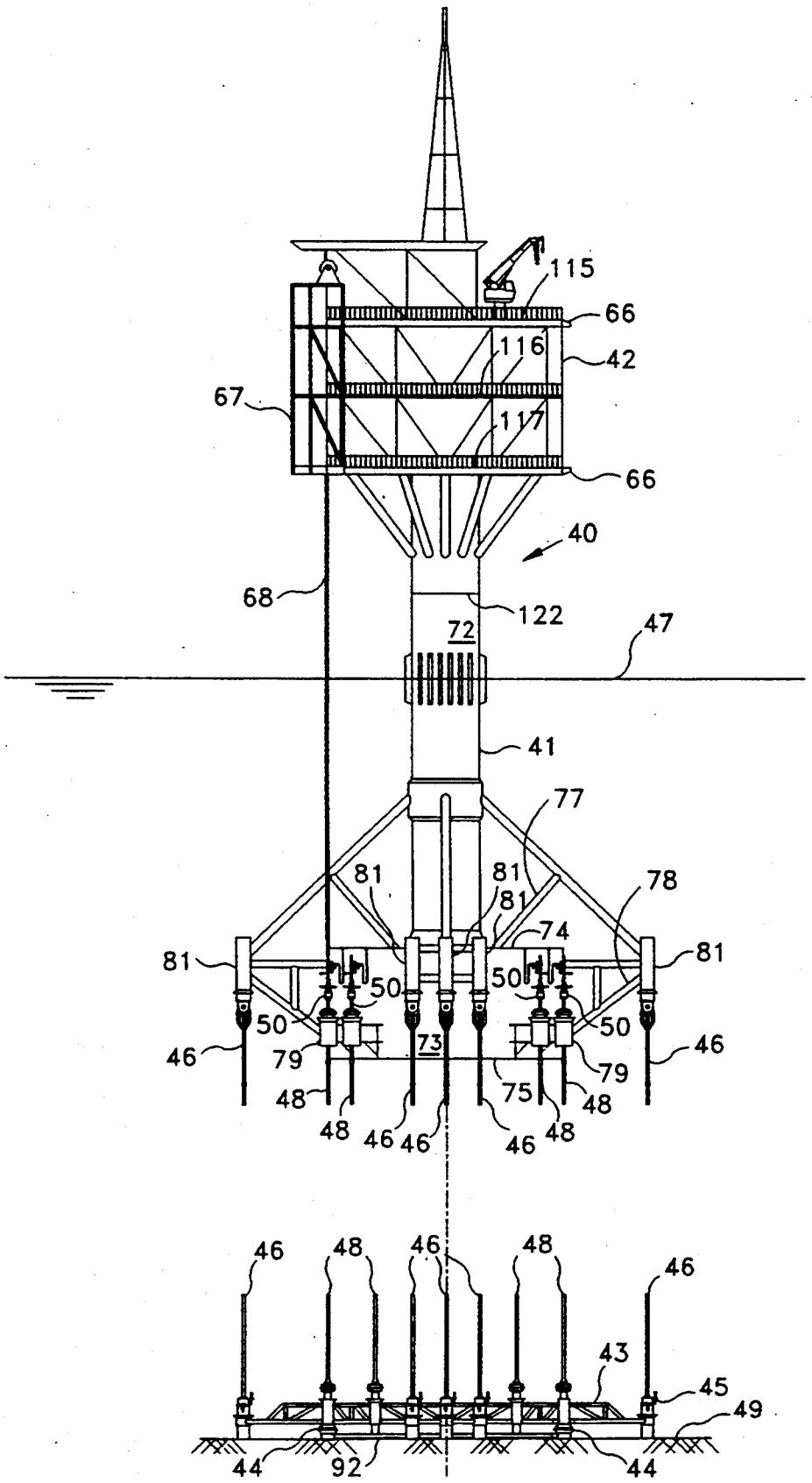
FIG. 1 is a side elevational view of a single column tension leg platform for offshore well workover and/or production operations in accordance with a preferred embodiment of the invention.
Figure 2:
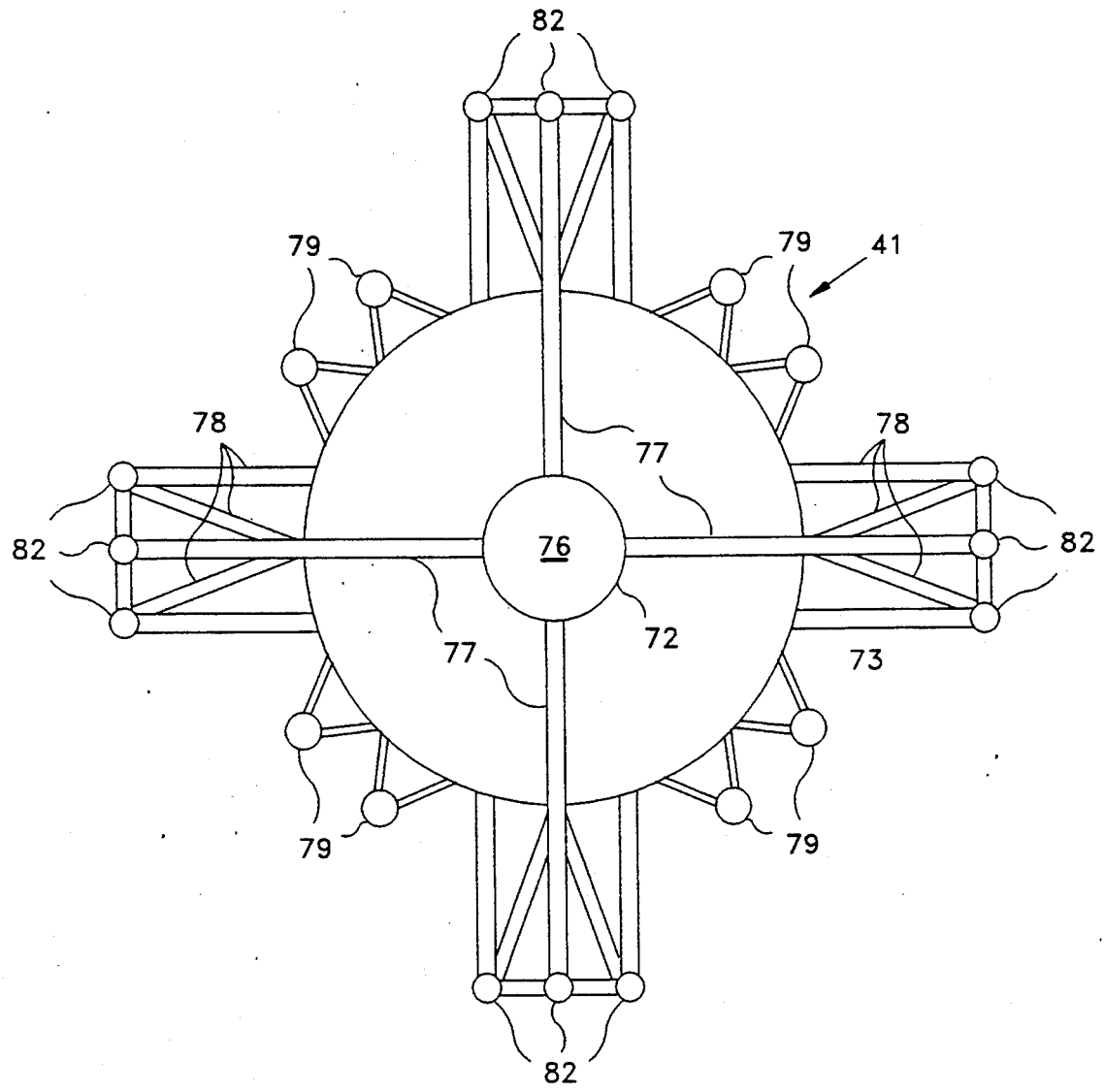
FIG. 2 is a plan view of the below water surface portion of the platform hull and is a preferred embodiment of the hull.
Figure 3:
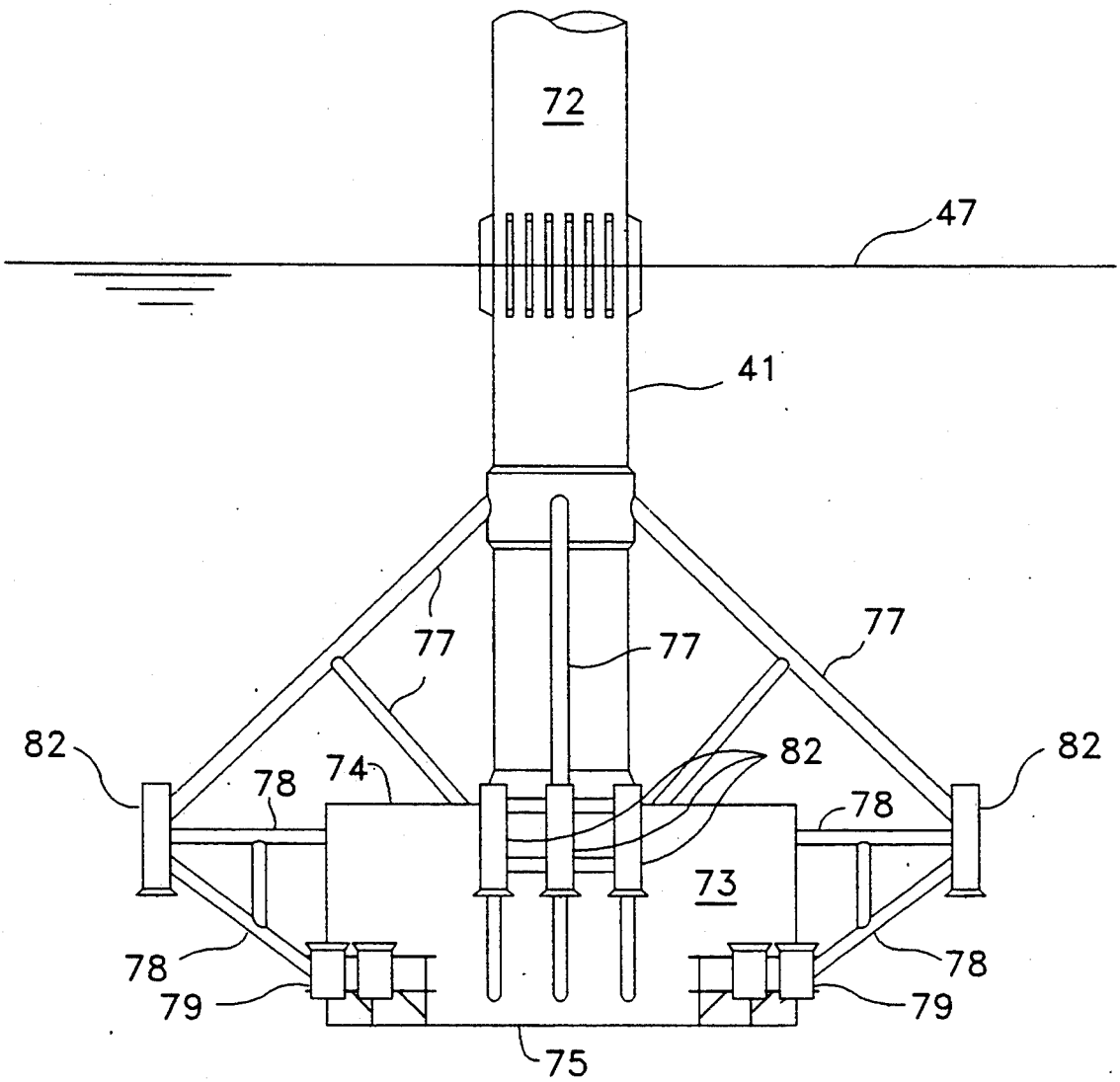
FIG. 3 is a partial elevation view of the platform hull showing the submerged portion of the hull and the various components which are attached to the main body of the hull.
Figure 4A:
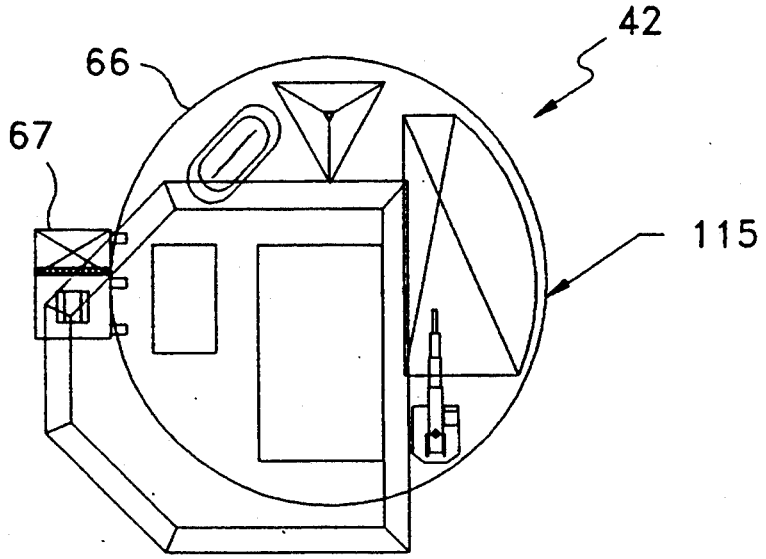
FIGS. 4A, 4B, and 4C are plan views of the floor levels of the platform deck and of typical locations for typical platform production equipment and facilities.
Figure 4B:
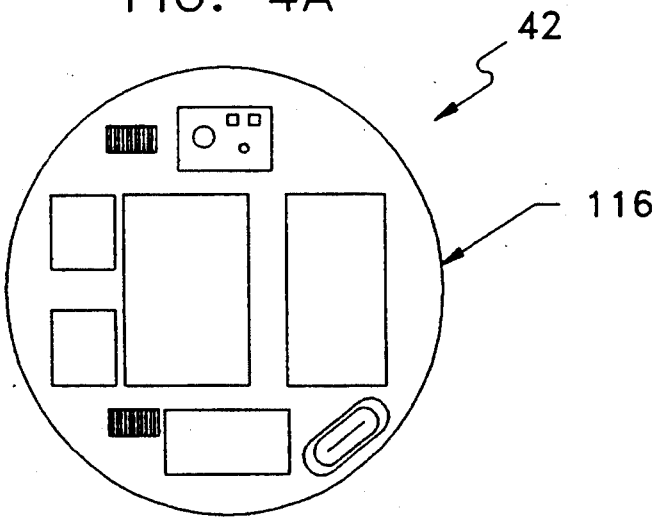
Figure 4C:
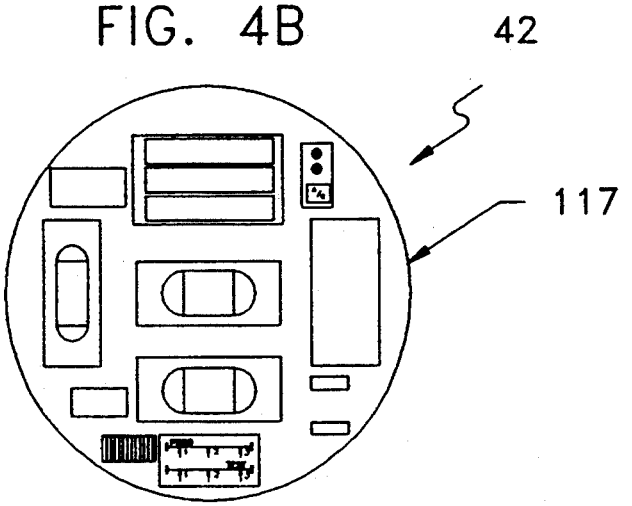

Referring now to the drawings, in FIG. 1, there will be seen an elevation view representation of an offshore tension leg production platform 40 in accordance with a preferred embodiment of the invention. In FIGS. 2 and 3 may be seen a plan and elevational view, respectively, of the platform hull 41 and in FIGS. 4A–4C may be seen plan views of the platform deck 42. In general terms, as seen in FIG. 1, the subject offshore platform comprises a seabed template 43, which may or may not have supporting piles 44, and foundation anchor piles 45, a buoyant hull 41, which is anchored by tendons 46 connected to each of the anchor piles 45, and a deck 42 supported above the water surface 47. The well risers 48 from the seabed 49 are supported near the base of the hull, the well risers and trees 50 thus being submerged below the water surface 47.

Context Of The Invention

Figure 5:
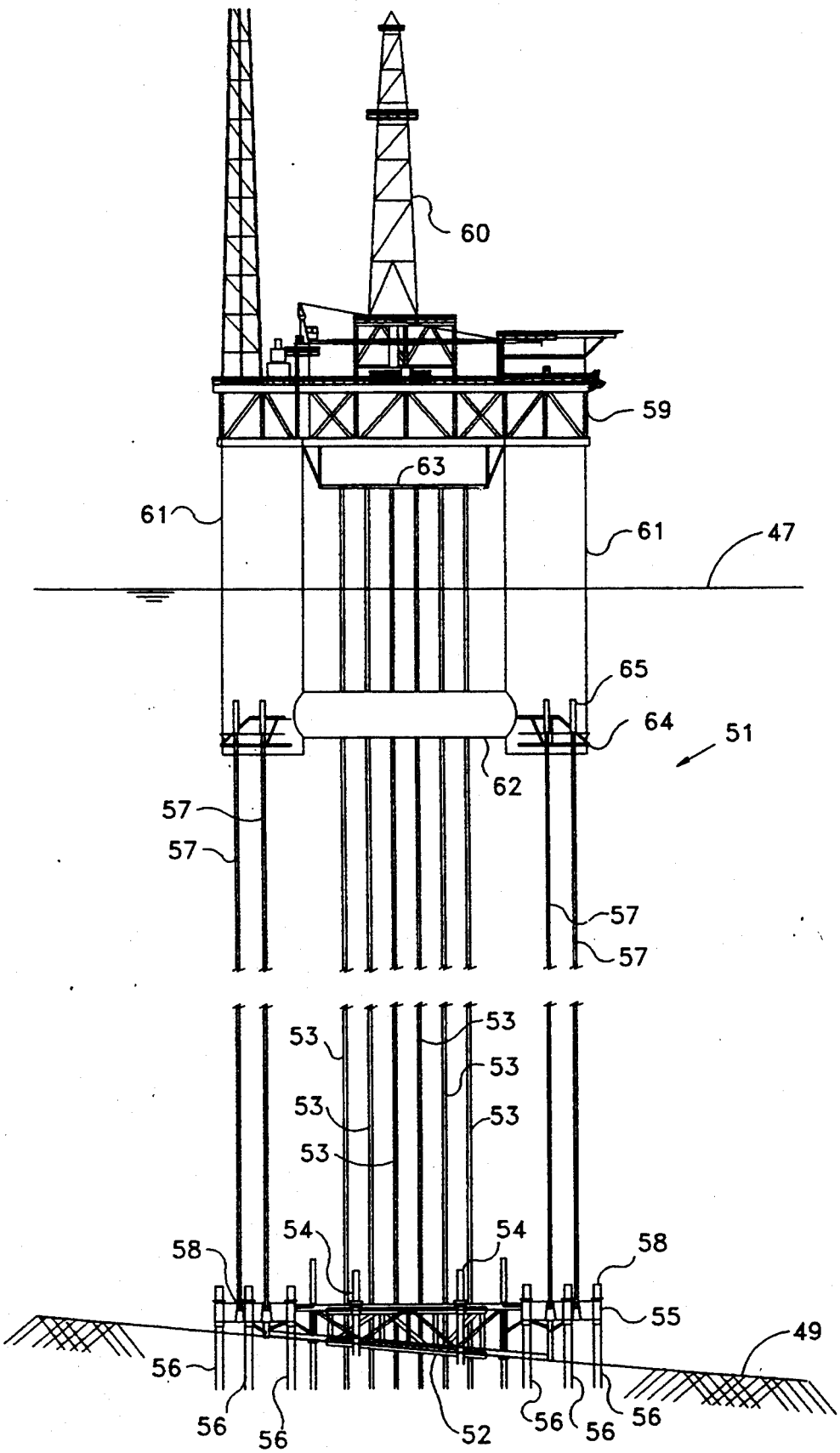
FIG. 5 (PRIOR ART)
FIG. 5 is an elevational side view of a conventional prior art tension leg platform and illustrates the major features of the prior art platform.

Before continuing with the detailed description of the subject platform, it may be worthwhile to briefly outline the context of the instant invention. In this connection, FIG. 5 schematically depicts a tension leg platform 51 of the prior art type previously constructed or proposed. This platform design embodies features which are necessary for its purpose but which determine its size, weight and complexity of manufacture and installation. A drilling template 52 seabed structure is provided to position and support the production wells 53. This structure is, in turn, supported by piles 54. The template includes means by which the structure's elevation and inclination may be adjusted. A separate seabed foundation structure 55 or structures are provided to anchor the platform. The foundations are secured to the seabed by steel tubular piles 56. These are too large to be installed by a conventional drilling vessel and equipment and in the past have been driven into the soil using specialist pile hammers, which in turn can only be operated by specially equipped installation vessels. The anchor piles 56 are permanently connected to the foundation structure(s) 55. The tendons 57 are connected to the foundation structure(s) 55 and not directly to the anchor piles 56. To sustain the imposed loadings, the tubular steel tendons 57 are manufactured with high technology materials and assembly procedures. They have been either assembled ashore as complete units or sections have been jointed at site using specialist connectors and handling equipment. In both cases, special means, vessels and procedures must be used for the tendons transportation to and installation at site.

To resist high fatigue loadings at the tendon connections, special complex means 58 are provided for freedom of rotation and to sustain cyclic loading variations. To support the high tendon pre-load tensions, the large deck 59, full well drilling facilities 60 and the deck-supported well risers and trees, the hull is configured with multiple vertical columns 61 which are joined by submerged pontoon elements 62. The resistance of the multiple columns to environmental loadings results in the need for higher tendon tensions to prevent pitching and rolling motions of the platform. Similarly, the larger waterplane area of the columns results in higher heave induced loadings in the tendons.

In order to perform many operations on a well, the drilling rig 60 must be located directly above the seabed wellhead. On prior art tension leg platforms, this requirement has been fulfilled in one of two ways. The rig is movable and is positioned as desired on the platform deck. The movement of the large well drilling rig has to be accompanied by adjustment of the hull water ballast placement in order that tension forces in each of the tendons remain within limits equal. This requirement to adjust the volume and location of hull water ballast in turn means that the submerged portion of the hull must be large enough to provide corresponding excess volume and ballast position flexibility. The alternative means of positioning the rig without adjustment of the hull water ballast is to change the plan position of the hull with respect to the subsea wellheads. Means of positioning the hull which have been proposed are either providing a platform mooring system and by adjusting the lengths of the mooring lines, moving the platform to the desired position, or equipping the hull with ship-type multiple thrusters which propel the hull to a desired horizontal offset position and thereafter maintains the position whilst operations are performed on a given well. Both alternatives require additional platform means and complexities which increase the weight which, in turn, increases the size of the hull, tendons and anchor foundations.

Prior art tension leg platforms support the well risers at the deck 63 where the trees are located, and the deck structure must therefore be strengthened to support the risers and transmit the payload to the columns of the hull, and the resulting increased weight of the deck results in an increase in the size of the supporting hull. The tendons, however, are connected 64 at the optimum elevation at or close to the keel of the hull. When the platform is subjected to horizontal environmental loadings of wind, waves and current, the resulting forces push the hull sideways. However, since the hull is restrained vertically by the anchored tendons, the horizontal offset movement is accompanied by a corresponding downward vertical movement. This increase of the hull draft is known as platform "setdown". When this occurs, the elevation of the tops of the well risers must be changed with respect to the elevation of the deck in order that the tension loads in the riser remains constant within defined limits. The changes in the riser lengths are caused by the difference in the distance between the bottom and the top points of connection of the tendons and the risers. In order to prevent variations of the risers tensions, these are suspended from the platform deck with variable stroke, constant tension devices. This equipment increases the platform complexity; and due to its weight, the size of the submerged portion of the hull must be increased to provide support for this payload. A basic feature of the tension leg platform concept is that within prescribed limitations, the pretension loading in each tendon must be equal. Prior art platforms have incorporated complex means 65 for adjusting the effective length and pretension of each tendon during the installation operations of connecting said tendons to the hull.

Figure 6:
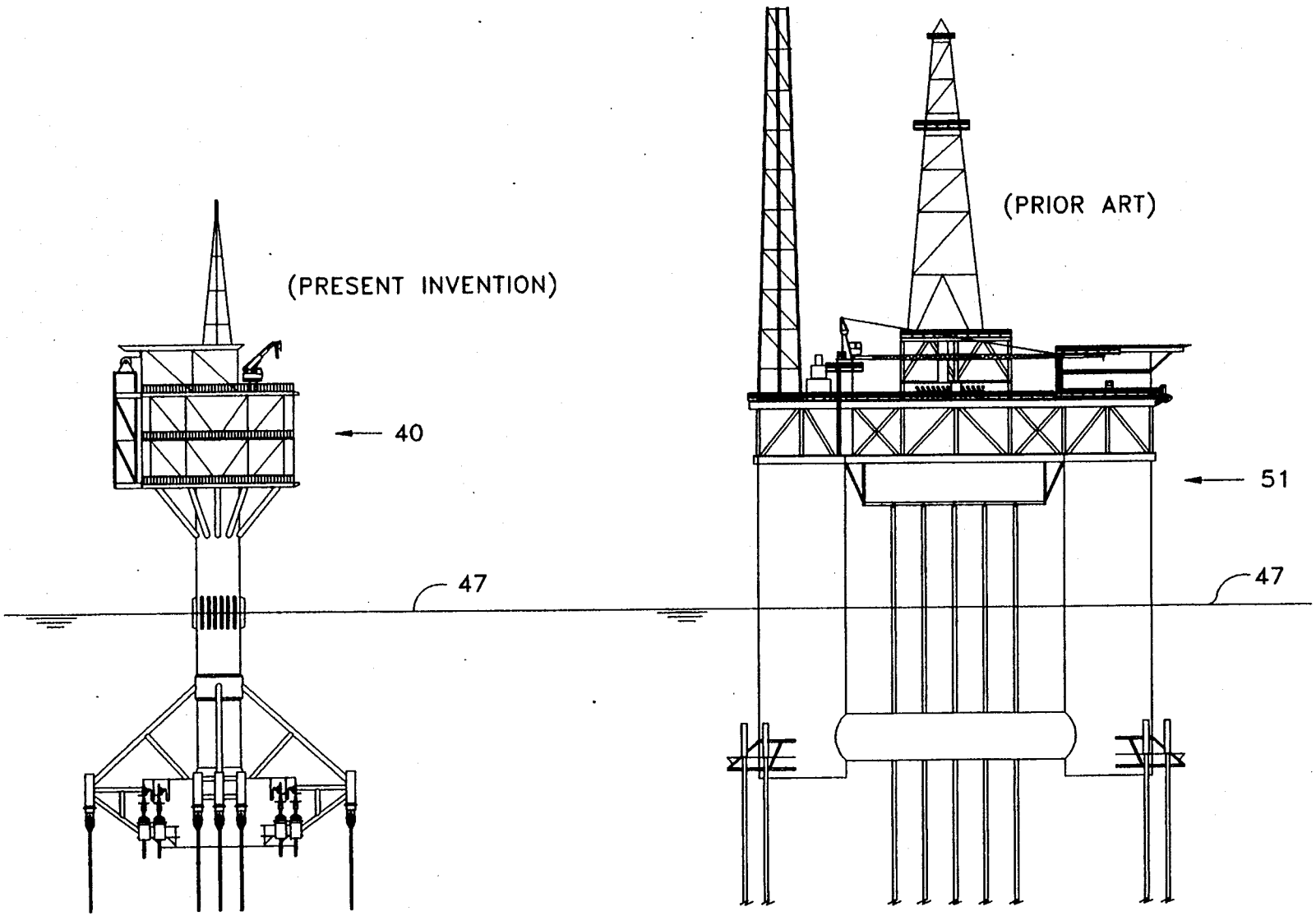
FIG. 6 shows, side by side and to the same scale, an elevational side view of a prior art tension leg platform hull and deck which was in whole illustrated in FIG. 5, and an elevational side view of the present tension leg platform, and illustrates the compact reduced size of the present platform compared to the prior art platform.

FIG. 6 shows elevational side views of a prior art tension leg platform 51 and a tension leg platform 40 in accordance with the present invention, side by side and drawn to the same scale, thereby illustrating their relative sizes.

Platform Structure

Figure 7:
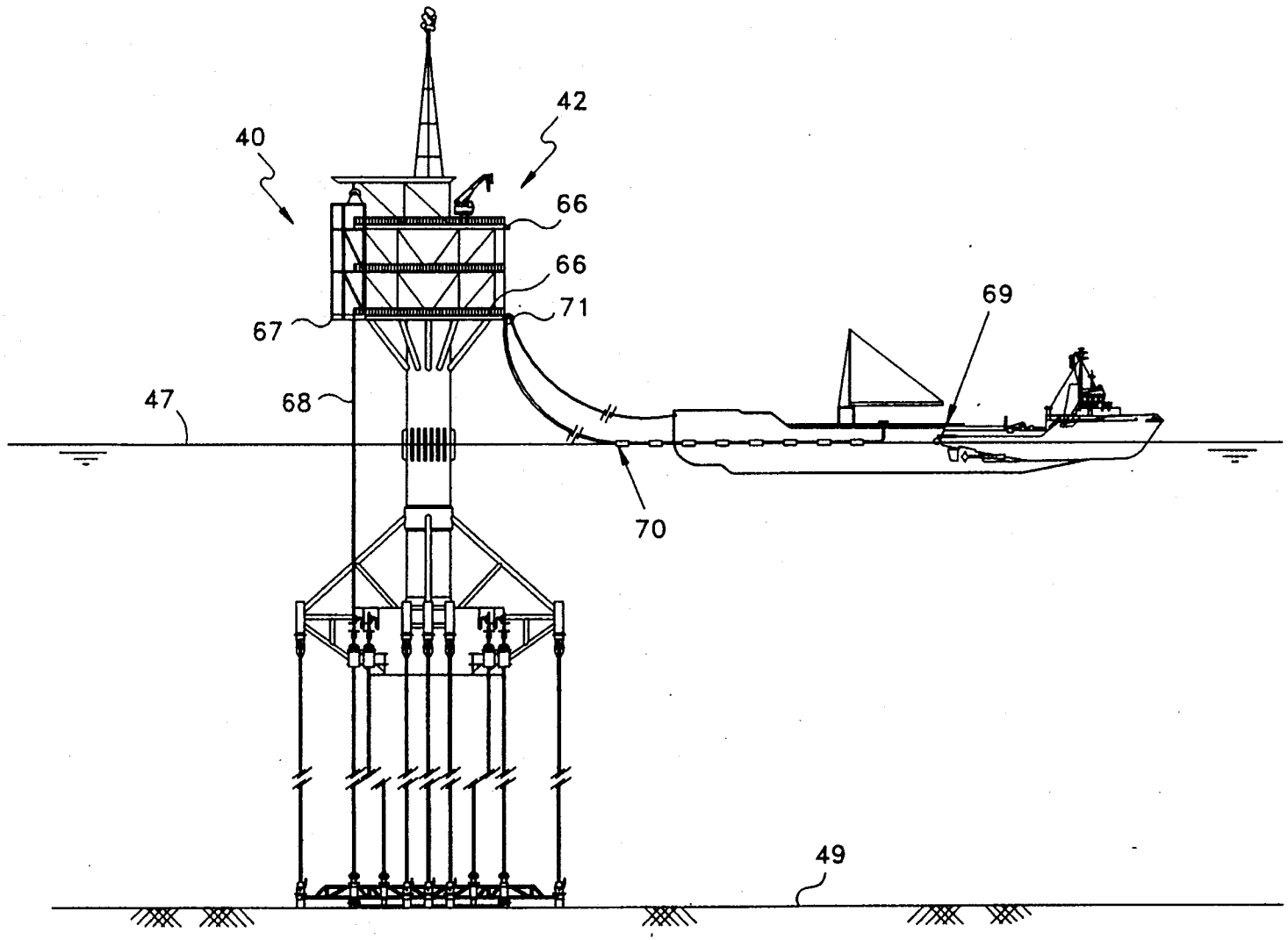
FIG. 7 is a side elevational view of the platform with a tanker moored to the platform and with product export loading hose connected from the platform to the tanker.

Referring again to FIGS. 1, 2, 3, and 4A–4C, the platform 40 of the present invention incorporates a deck 42 which has an elevation clear above the zone of wave action, the deck has an upper level 115, a mezzanine level 116 and a lower level 117, however alternative arrangements may be used. The deck has a circular planform with perimeter trackways 66. A moveable well workover rig platform 67 is provided and supported on the deck trackways 66. This workover rig 67 is used to perform all normal production well operations with the exception of the actual drilling of wells. The rig 67 can be moved around the deck trackway 66 to any location and thus positioned directly above each of the well trees 50, the wells being positioned in a circle corresponding to the circular travel path of the workover rig. A vertical riser 68 provides connection between the well tree and the platform deck 42. A means of mooring 71 a tanker 69 to the platform and connecting an offtake hose 70 from the platform to the tanker is provided (FIG. 7). This is supported on a circular perimeter deck trackway 66 so that the mooring connection may be positioned on weather leeward side of the platform, no matter what the prevailing weather direction may be.

The overall cylindrical form of the deck presents less resistance to the wind than the flat sided form of conventional prior art platforms. The smaller horizontal wind loadings therefore result in correspondingly smaller overturning forces on the platform which, in turn, reduces the variation in the tendon tensions. The tendons 46 may therefore be maintained in tension with a reduced initial tension preload. This contributes to a basic objective of the platform concept to minimize the tendon tension loads and load variations thereby minimizing the size and number of tendons and size and number of anchor piles necessary to sustain the tension loadings.

The hull body 41 (FIGS. 1, 2 and 3) comprises basically an upper slender cylindrical column portion 72 and a lower major cylindrical portion 73. The hull configuration is hydrodynamically optimized to minimize responses of the platform to heave loadings caused by wave action of the water on the hull. The lower cylindrical portion 72 is positioned at a depth below the water surface 47 where the influence of wave action is minimized. The proportions of the lower portion 73 are hydrodynamically tuned so that the passage of waves against the immersed portion of the hull which, in turn, cause variations in the net buoyancy forces on the hull are minimized, and the changes of the buoyancy forces cause correspondingly reduced variations in the tension in the tendons. Tuning of the lower cylindrical portion 73 comprises the equalization or near equalization of the hydrostatic pressure effects on the upper 74 and lower 75 horizontal surfaces of the lower cylindrical portion. The difference in area of the horizontal surfaces is the horizontal area 76 of the upper cylindrical portion 72 of the hull. By placing the upper and lower horizontal surfaces at a prescribed distance apart, the surfaces are subject to a difference of vertical pressure loading caused by the passage of waves. The upper horizontal surface 74 being in closer proximity to the water surface is subjected to higher wave-induced pressure variations than the lower horizontal surface 75. The proportions of the lower cylindrical portion 73 of the hull are hydrodynamically tuned so that the total wave induced pressure on the upper horizontal surface is balanced by the corresponding wave induced pressure acting upon the lower horizontal surface 75, and thus the heave response of the hull to the passage of waves is minimized.

The upper cylindrical portion 72 of the hull which passes up through the water surface 47 provides a physical connection 122 of the deck 42 to the hull lower portion 73 (FIG. 1). The buoyancy of the submerged part of the upper cylinder 72 provides support in part of the above water portion of the platform. The major portion of the platform's buoyancy is provided by the larger lower cylindrical portion 73.

It is desirable that the area 76 of the hull which passes through the waterplane is as small as possible. The small waterplane area 76 minimizes the variation of the hull buoyancy which is caused by the passage of a wave which, in turn, results in a variation of the water level 47 with respect to the vertically anchored hull. Notwithstanding the foregoing desire to minimize said waterplane area, it is also an objective of the invention that the hull structure may be installed without the requirement for a cranevessel or temporary auxiliary buoyancy means. The upper portion 72 of the hull is therefore dimensioned so that the waterplane area is adequate to ensure the hull remains hydrodynamically stable when the lower portion 73 of the hull is completely submerged. As an alternative, a plurality of smaller slender columns, but together having similar equivalence in waterplane area, net buoyancy and resistance to environmental loading may be used in substitution for the single cylindrical portion 72. In summary, the hull 41 is configured so that the body is buoyant and stable during towed transportation from shore to the site and also during the installation of the hull and its connection to the tendons 46, and so that the hull has minimal motion responses to hydrodynamic loadings. In order to vary the net buoyancy and center of gravity position of the hull, the lower portion 73 is provided with a plurality of buoyancy/ballast chambers together with means of varying the quantity of ballast contained in the chambers.

In addition to the upper 72 and lower 73 cylindrical portions of the main body 41, the hull is provided with structural bracings 77 which contribute in part to the structural connection of the upper and lower portions. Additional structural members 78 attached to the lower portion 73 provide the means of connecting the hull 41 to the tendons 46. The distance between the tendons 46 is larger than the diameter of the hull lower portion 73. The distance between the tendons 46 defines the magnitude of the variation of the loadings in the tendons which are caused by horizontal environmental and external loading to which the platform is subjected. Increasing the distance between the tendons, which is a moment lever arm, reduces the variation in loadings in the tendons.

Figure 8:
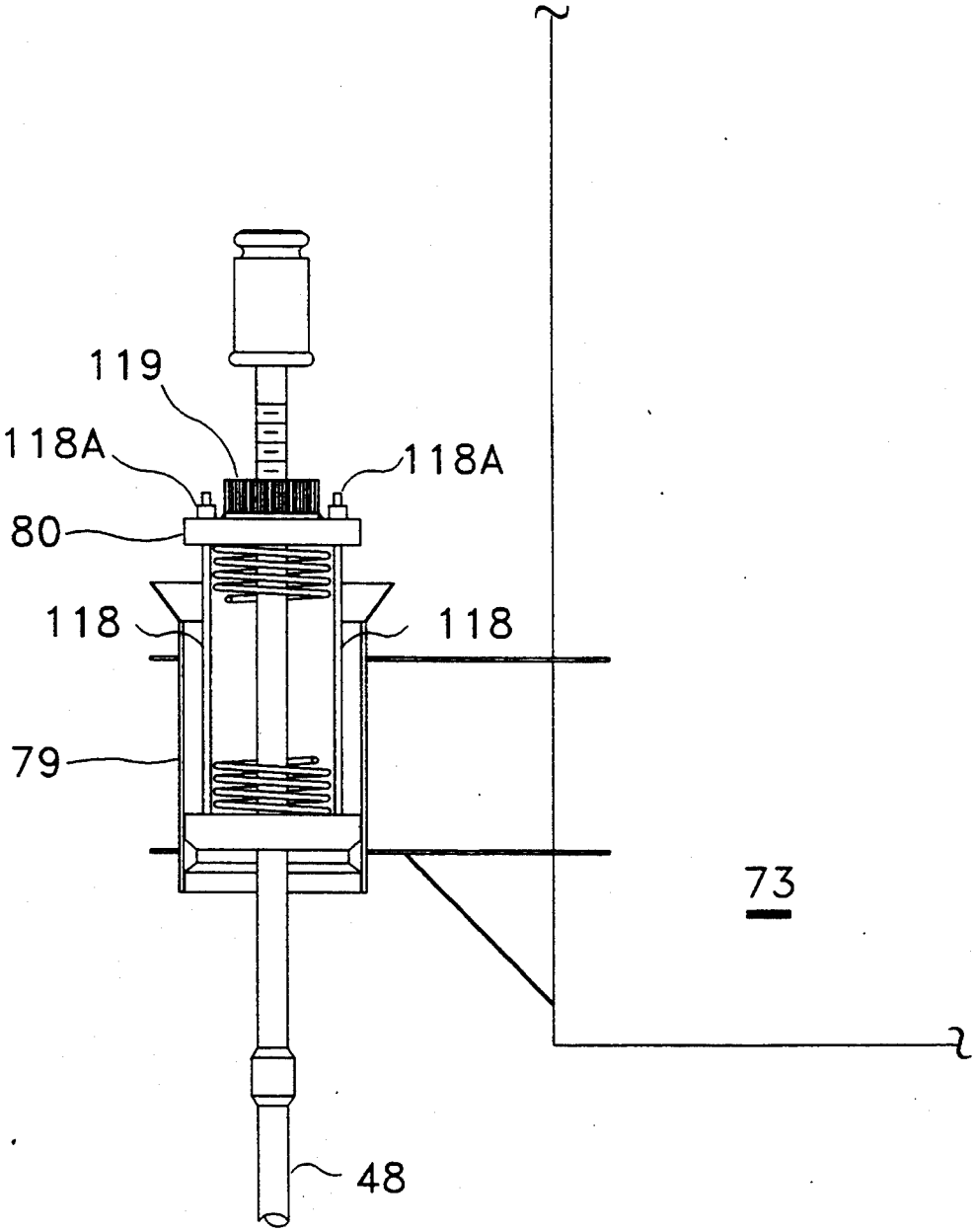
FIG. 8 is a sectional view of a well riser support showing the means of supporting the weight of the riser and tree, and of maintaining the tension of the riser constant.

Attached around the perimeter of the hull lower portion 73, support structures 79 are provided which support the production well risers and trees. The supports 79 are positioned at this elevation so that the payload of the wells 50 is not supported at deck level thereby avoiding additional deck size and weight, it being a basic objective of the invention to minimize the above water weight and size of the platform. The elevation of the supports 79 is also desirable to be close to the elevation of the top connections of the tendons 46. The tendons 46 and risers 48 being of similar length minimizes, as previously mentioned, the effective length variation of the risers when the platform is "set down" when subjected to horizontal forces. As shown in FIG. 8, the riser supports 79 incorporate a means 80 of adjusting the riser tension to the desired magnitude and thereafter maintaining the tension within prescribed limits notwithstanding effective variations of the length of the risers 48. The means of riser support after installation of the risers requires no maintenance nor adjustment during the operation of the platform; this being desirable given that the supports 79 are submerged below the surface of the water 47.

Figure 9:
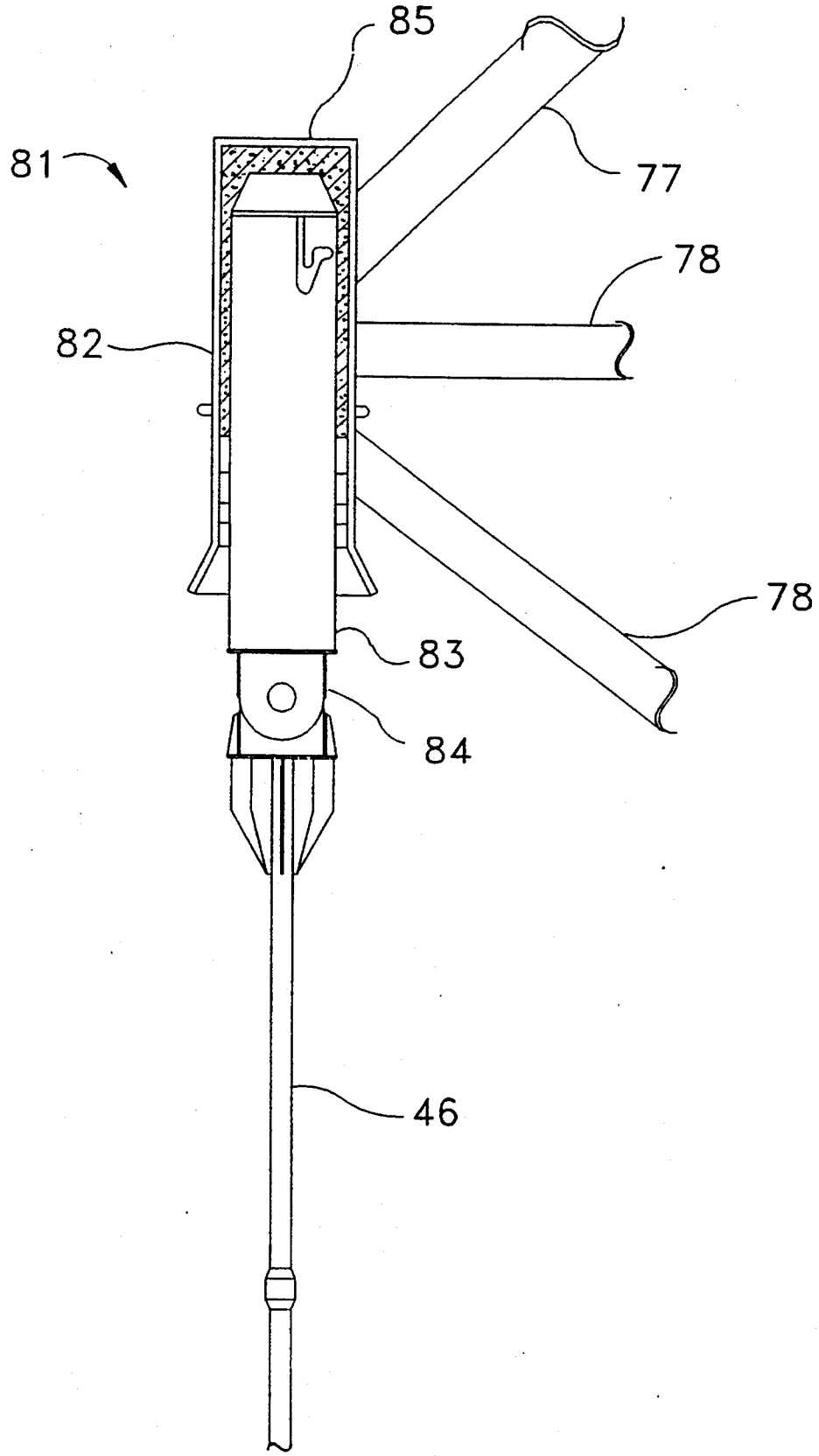
FIG. 9 is a sectional side view of the means of connection of a tendon to the hull.

As shown in FIG. 9, a means 81 of permanently connecting the hull 41 to the tendons 46 is provided. A vertical tubular steel sleeve receptacle 82 attached to the hull lower portion is provided for each tendon 46. A connection pipe 83 is attached by a cardan omnidirectional rotational joint 84 to the top of the tendon main body 46. The cardan joint 84 having two hinge pins with rotational axes at right angles provides omni- directional rotational freedom of the tendon with respect to the hull and facilitates future disconnection of the tendons from the hull. Alternatively a flex joint as used at the bottom connection may also be used at the top tendon connection. The pipe 83 is inserted into the sleeve 82. Cement grout 85 is pumped into the annulus volume between the outer sleeve 82 and inner pipe 83. The hardened and cured grout bonds to the inner and outer pipes thereby applied loads in the tendon 46 are transmitted to the inner pipe 83 through the grout to the outer sleeve 82 and thereafter to the hull body. The grouted connection 81 does not require the precise relative positioning of the inner pipe 83 and outer sleeve 82 and hence provides a means of accommodating tendon lengths variations and hence avoids all need for other means of adjustment of the tendon lengths.

Figure 10:
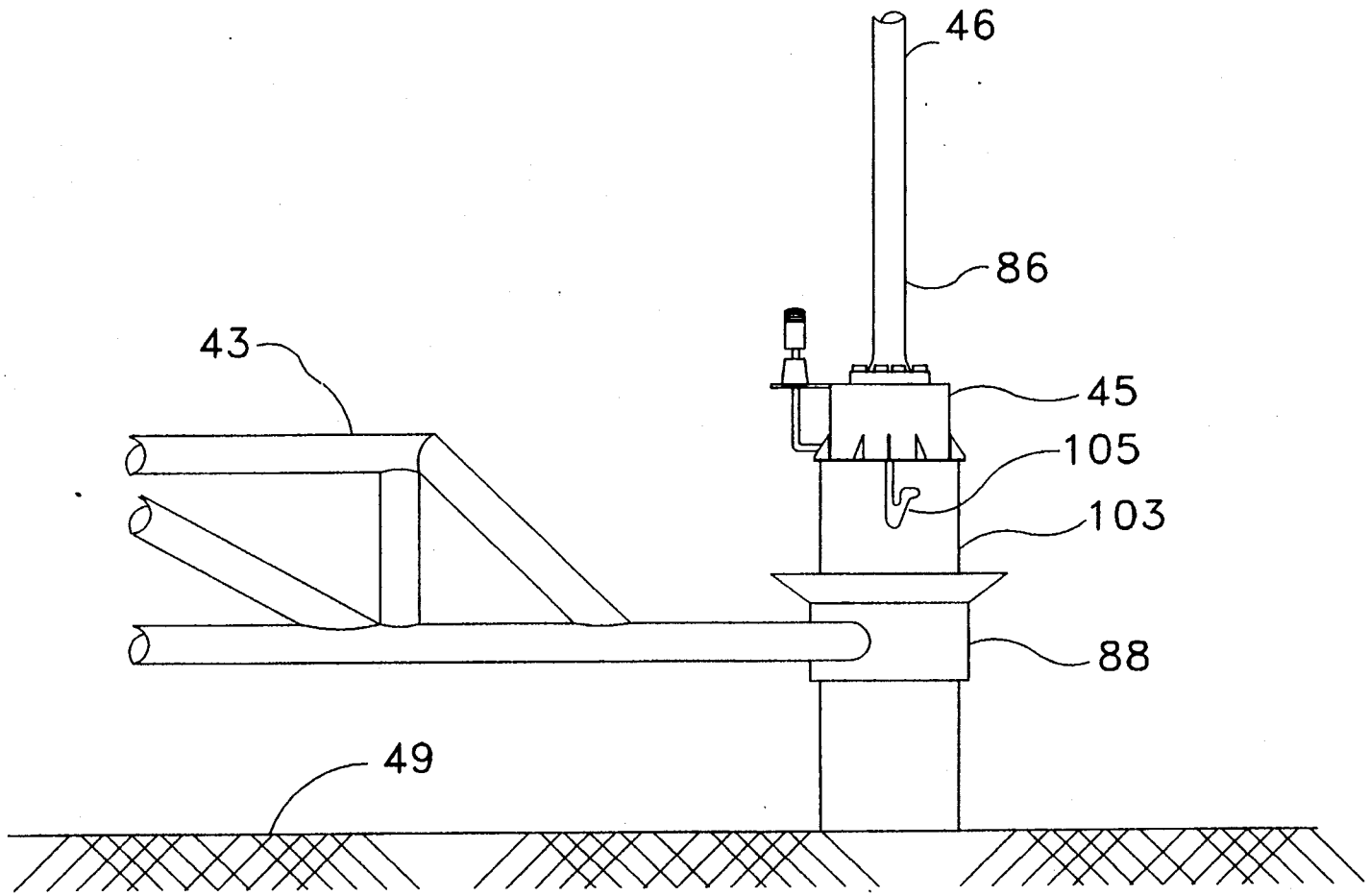
FIG. 10 is an elevational view of an installed foundation anchor pile showing how the pile is positioned by the seabed template structure and how a tendon is connected to the foundation pile.
Figure 11:
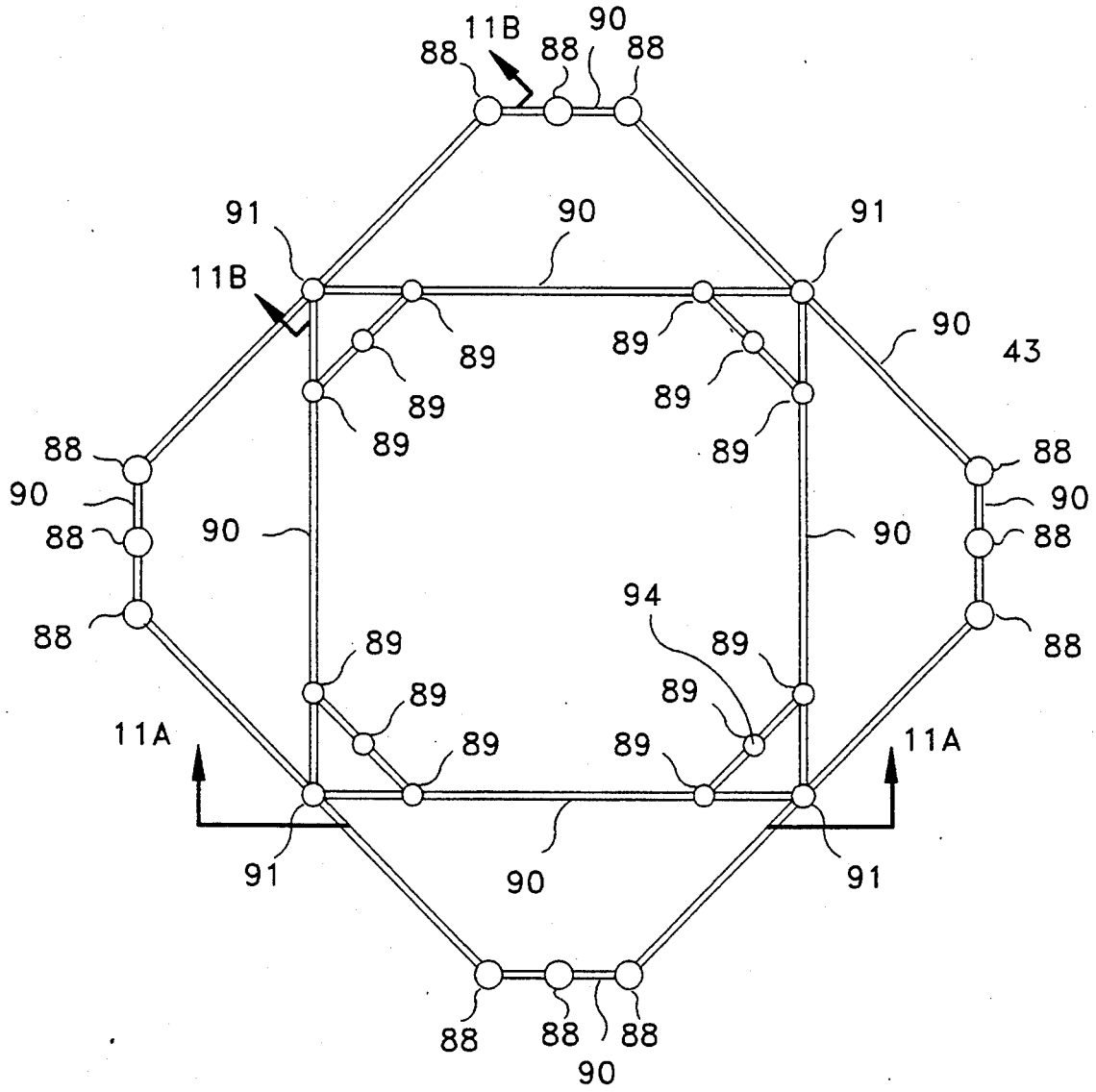
FIG. 11 is a plan view of a preferred embodiment of the seabed template structure which positions the foundation anchor piles and production wells.
Figure 11A:
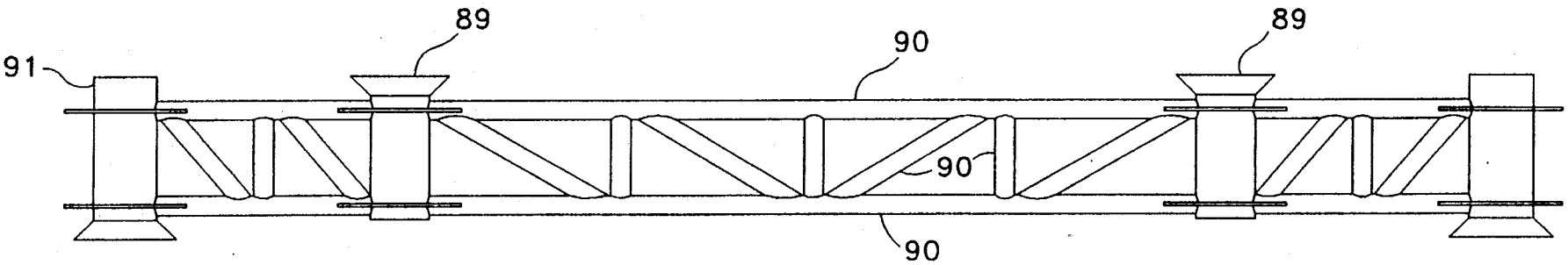
FIGS. 11A and 11B are sectional views of the seabed template structure, the positions of which are shown in FIG. 11.
Figure 11B:
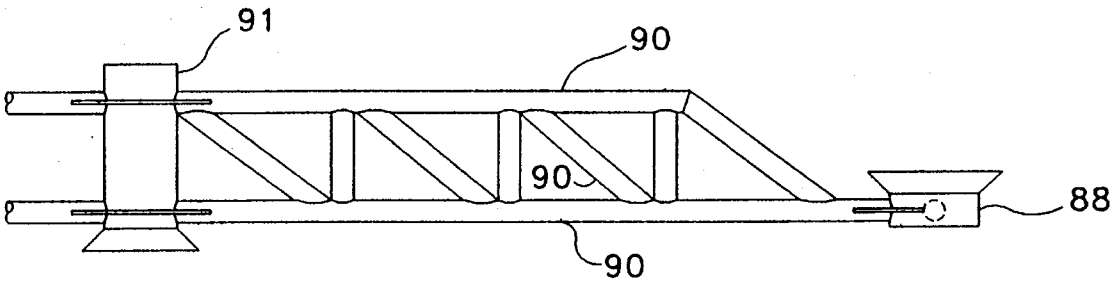
Figure 12C:
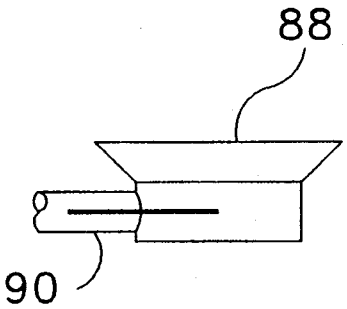
FIGS. 12A–12C and 12D are elevational views and a plan view, respectively, of a support pile receptacle, a well guide receptacle, and a foundation pile receptacle, of the template structure.
Figure 12B:
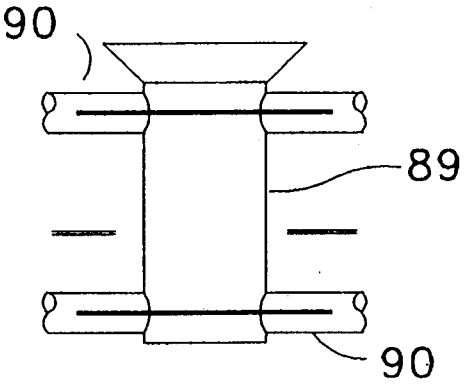
Figure 12D:
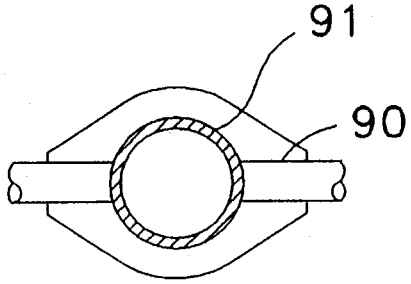
Figure 12A:
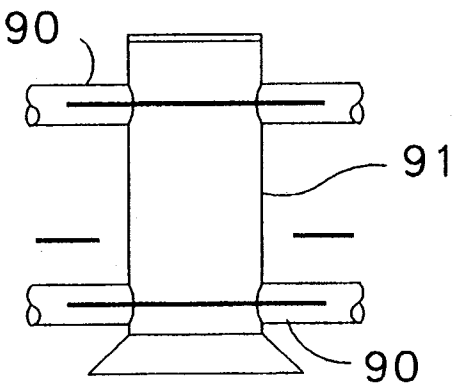

The elongated tubular tendons 46 connect the hull 41 to the foundations so that the hull is vertically anchored to the seabed 49. The number of tendons provided is variable and must be sufficient to provide the desired total anchoring pretension force on the hull. It is an object of the platform concept that the tendons may be manufactured using conventional steel tubular pipe segments as used for well drilling operations and practices. The use of said materials for the manufacture of the tendons influences the quantity of tendons necessary to provide the desired anchorage of the platform 40. As best seen in FIG. 10, the lower extremity of the tendon 46 comprises a steel or other metal section which has varying diameter and thickness, known as a flex joint 86. Such joints are conventionally used in the industry for the bottom connection of deepwater rigid steel pipe well risers during drilling operations. The flex joint dimensions and material of manufacture permit the tendon 46 to articulate with respect to the fixed anchor pile 45. Each platform tendon 46 is anchored independently to the seafloor by a steel tubular pipe pile 45 which is penetrated into "the subsoil 87, which in turn anchors the pile.

As best seen in FIGS. 11, 11A–11B, and 12A–12D, the seabed template structure 43 is manufactured with steel tubulars 90 and plate. The template structure 43 incorporates guide receptacles 88 which position the anchor piles 45 and guide receptacles 89 which position the wells 50. As previously mentioned, depending on the load supporting capacity of the seabed soil, the template structure may either be supported directly by the seabed surface 49 or by support piles 44 which penetrate into the subsoil 87. In the case of the latter support means, the template structure incorporates pipe receptacles 91 which correspond to the support piles 44. The support piles 44 are positioned by a simple steel pin pile frame structure 92 (FIG. 13) which is placed on the seabed. The frame 92 incorporates guide receptacles 93 for the piles 44.

Method Of Installation

With the exception of the deck 42, the whole platform may be installed at site using a conventional deepwater drilling vessel, equipment and practices. Other methods and means may also be used. A semisubmersible drilling vessel (SSDV) may also be used to drill the platform production wells; therefore, if the vessel is used to perform all the work, well drilling and platform installation works may be integrated and, for example, the foundation piles may be installed before, during or after the operations of drilling the production wells. For the purposes of this description, it is assumed that the wells are drilled prior to installation of the foundation anchor piles. It is further assumed that the seabed template 43 structure is supported by piles 44. The components of the platform are sequentially installed at the site as described below.

The pin piles 44, anchor piles 45 and tendons 46 are fabricated in sections. These are boat-transported to the SSDV installation vessel at site, assembled and deployed vertically by the rig using standard drilling practices and equipment.

Specialized installation vessels and equipment, such as underwater pile hammers, are not required for installation. This is particularly significant for platform sites where such vessels are not normally based. The sequence of operations is as follows:

Pin Pile Frame

Figure 13:
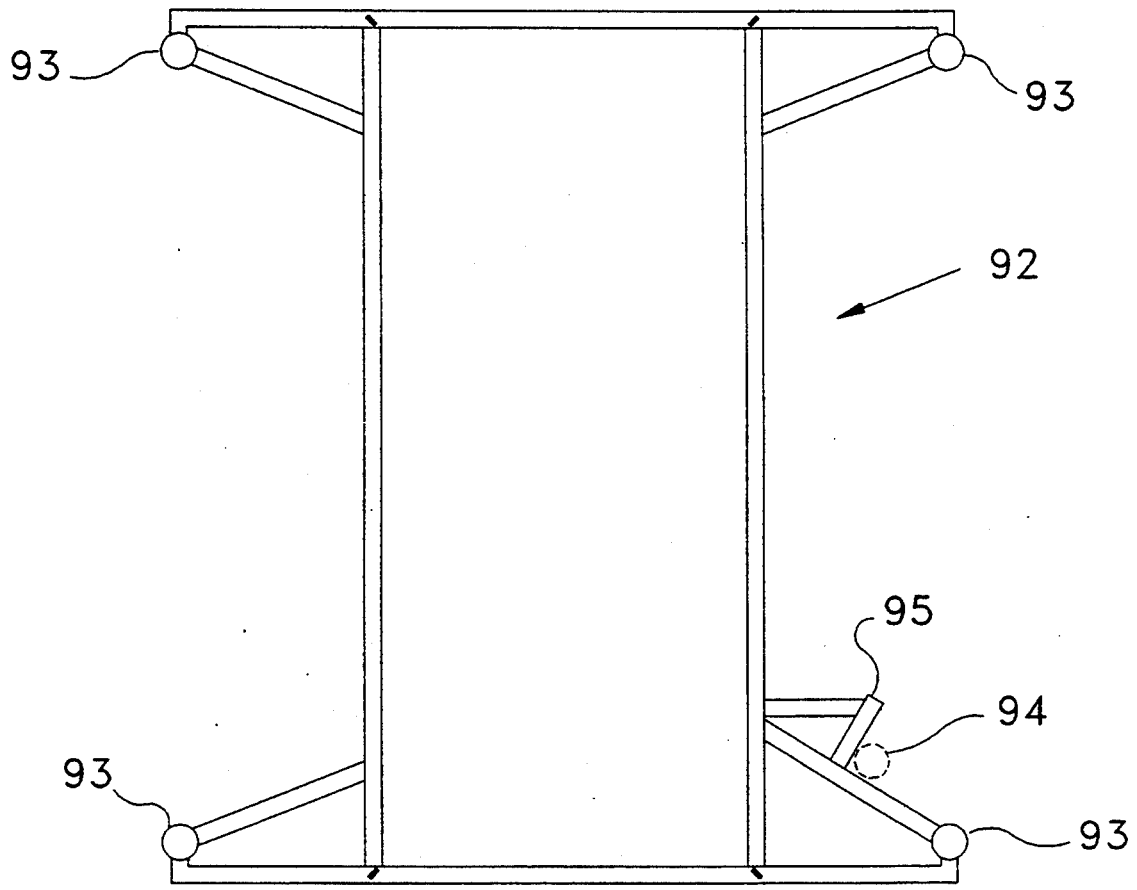
FIG. 13 is a top plan view of a pin pile frame which when placed on the seabed positions support piles for the template structure if and when it is desirable to support the template and shown with a guide to position the frame and consequently the template structure in a desired location with respect to an existing seabed well.
Figure 14:
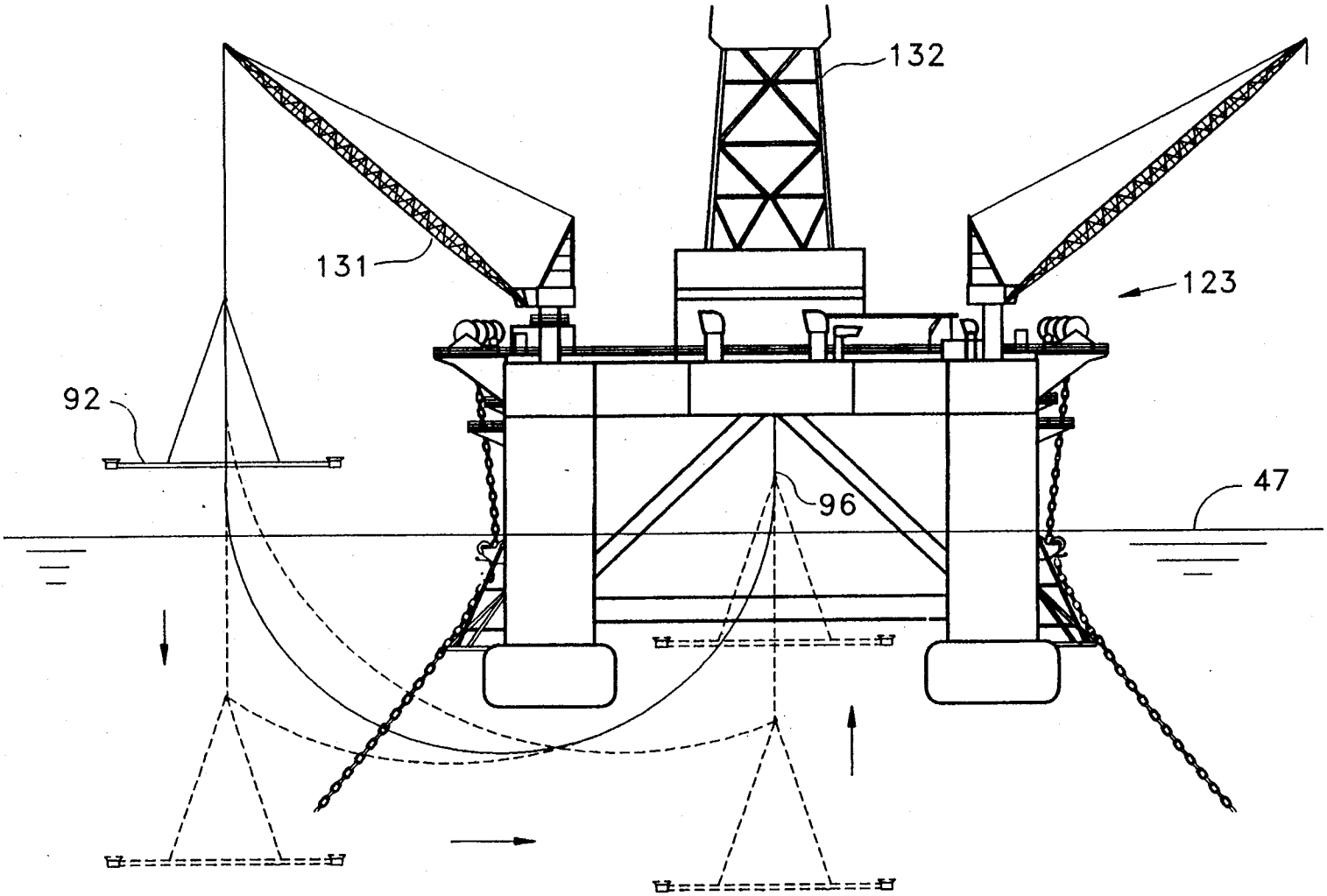
FIG. 14 shows a method of lifting the pin pile frame from a transport vessel and of suspending the frame from the rig hoist of a drilling vessel.

As shown in FIG. 14, the small, light pin pile frame structure 92 (FIG. 13) is loaded out onto a supply boat for transportation to the site where the drilling vessel 123 is moored up over the platform location. The frame 92 is lifted off, by a platform crane 131, keel hauled and suspended from the drilling riser 96 below the rig 132 (FIG. 14).

Figure 15A:
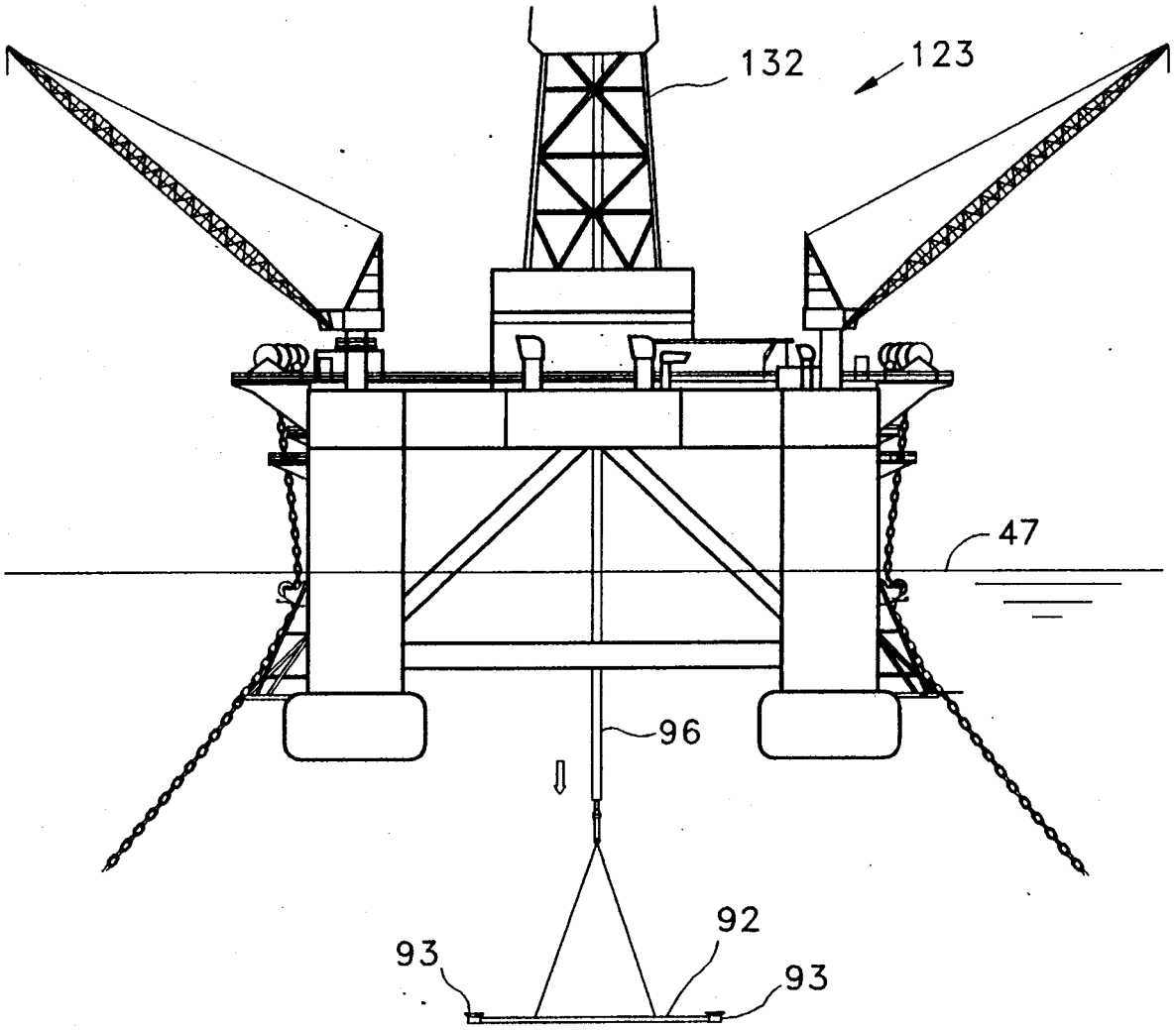
FIGS. 15A, 15B, and 15C show a method by which the pin pile frame may be lowered by a drilling vessel from near the water surface and emplaced upon the seabed and thereafter how piles for the support of the seabed template structure may be lowered and positioned by the frame and how the piles may be penetrated into the subsoil using conventional jetting procedures.
Figure 15B:
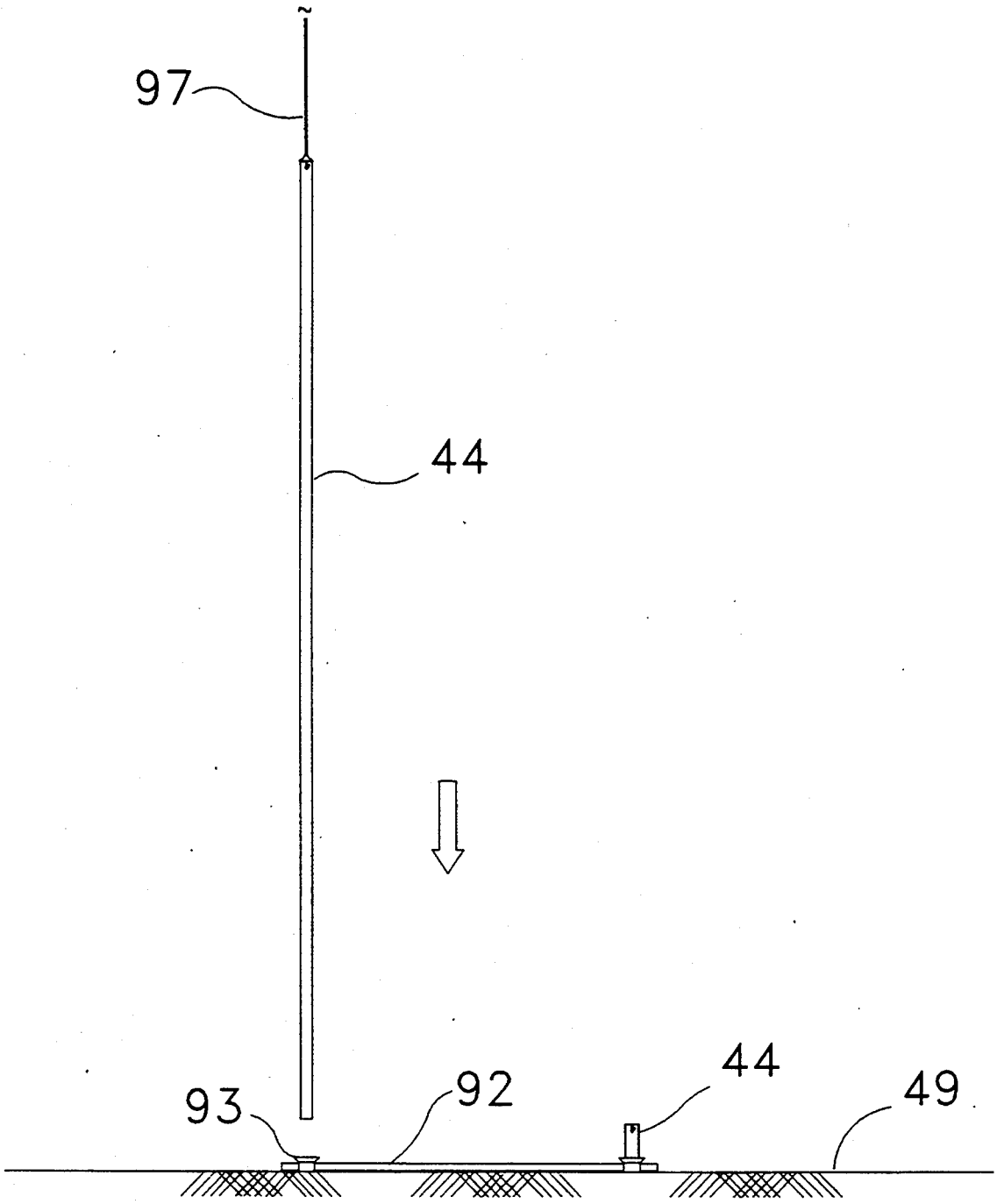

Assembling and running the riser string 96 (FIG. 15A), the frame 92 is lowered to the seabed and landed out. If an exploratory well 94 is to be used for production, the guides 95 of the frame 92 are used to index the frame with respect to the existing wellhead (FIG. 13). Using normal drilling procedures, pin piles 44 are assembled, lowered on the drillstring 97 and jetted to the required penetration (FIG. 15B). The pile elevations are then surveyed and height adjustment add-on cans 121 (FIG. 15C) are fabricated so that when installed later the pile tops are in the same horizontal plane.

Seabed Template

Figure 15C:
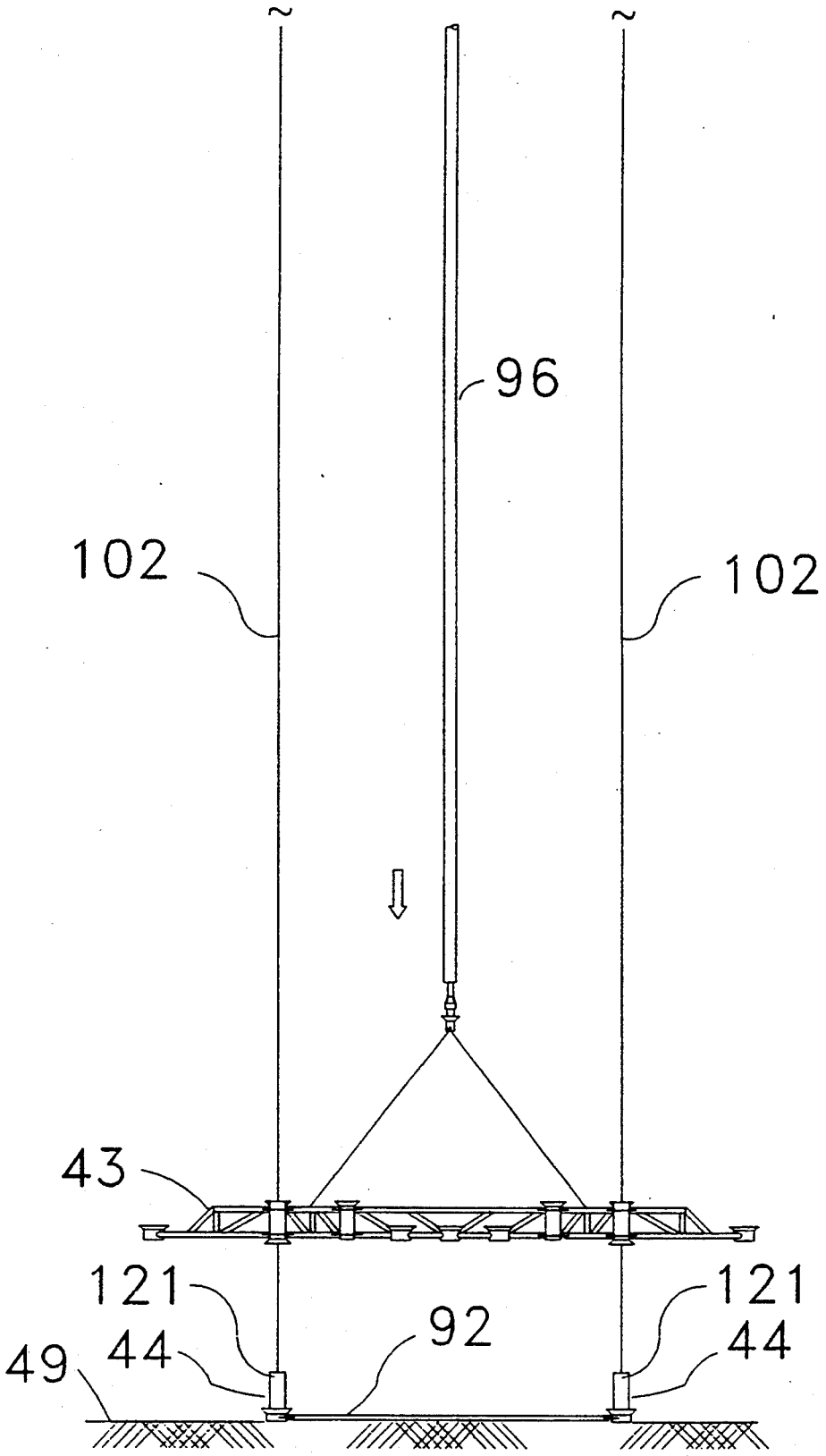
Figure 16A:
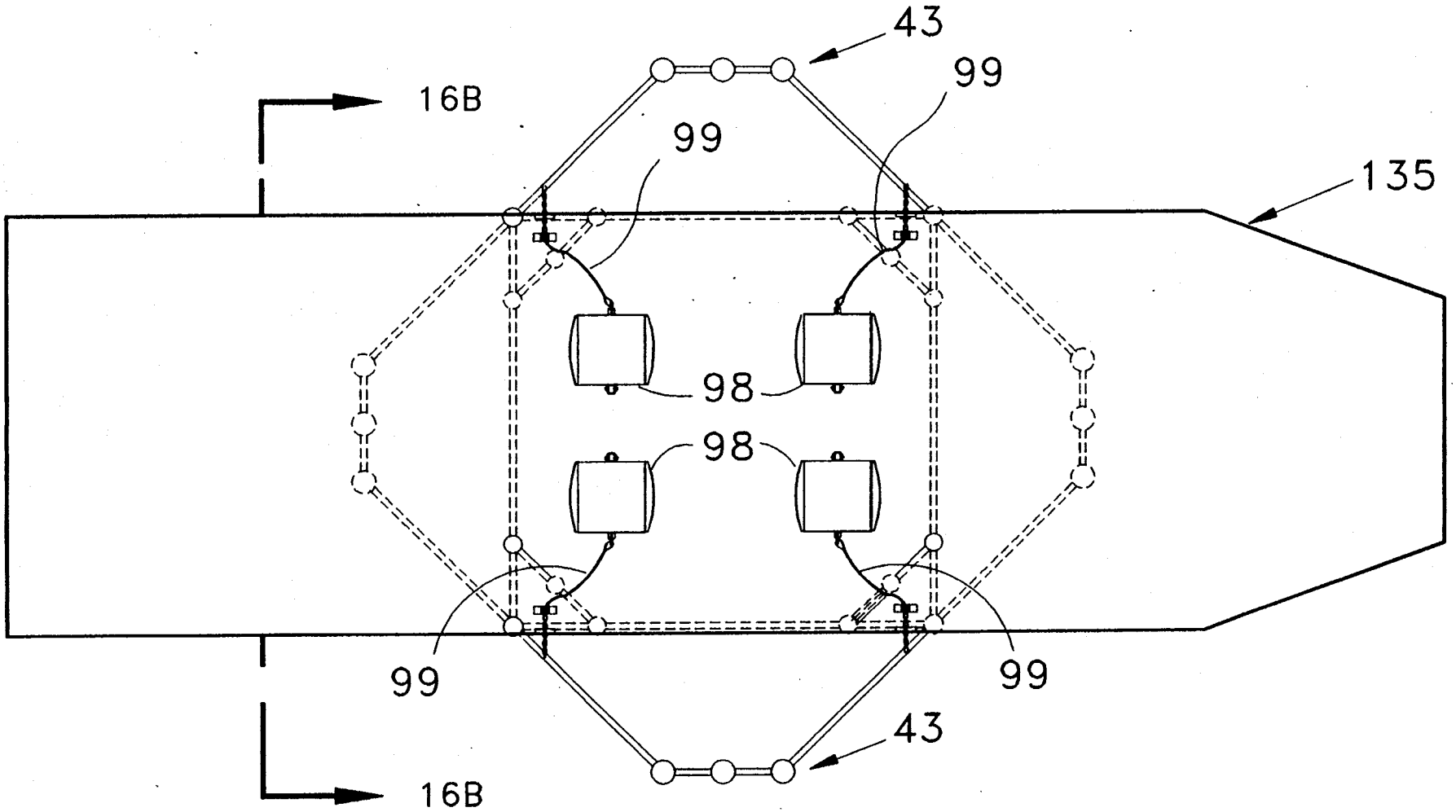
FIGS. 16A and 16B show a method by which the template structure may be transported, suspended beneath a conventional cargo barge.
Figure 16B:
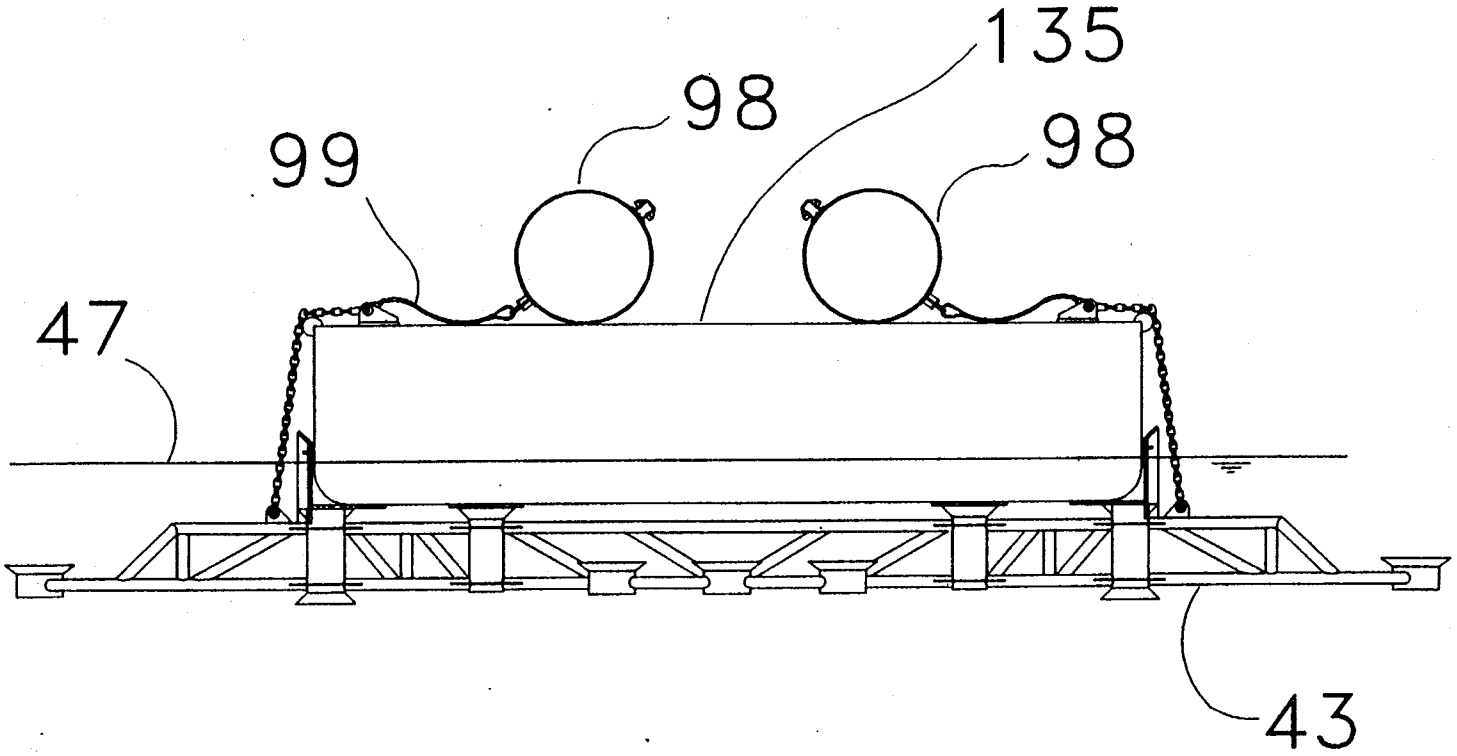
Figure 17:
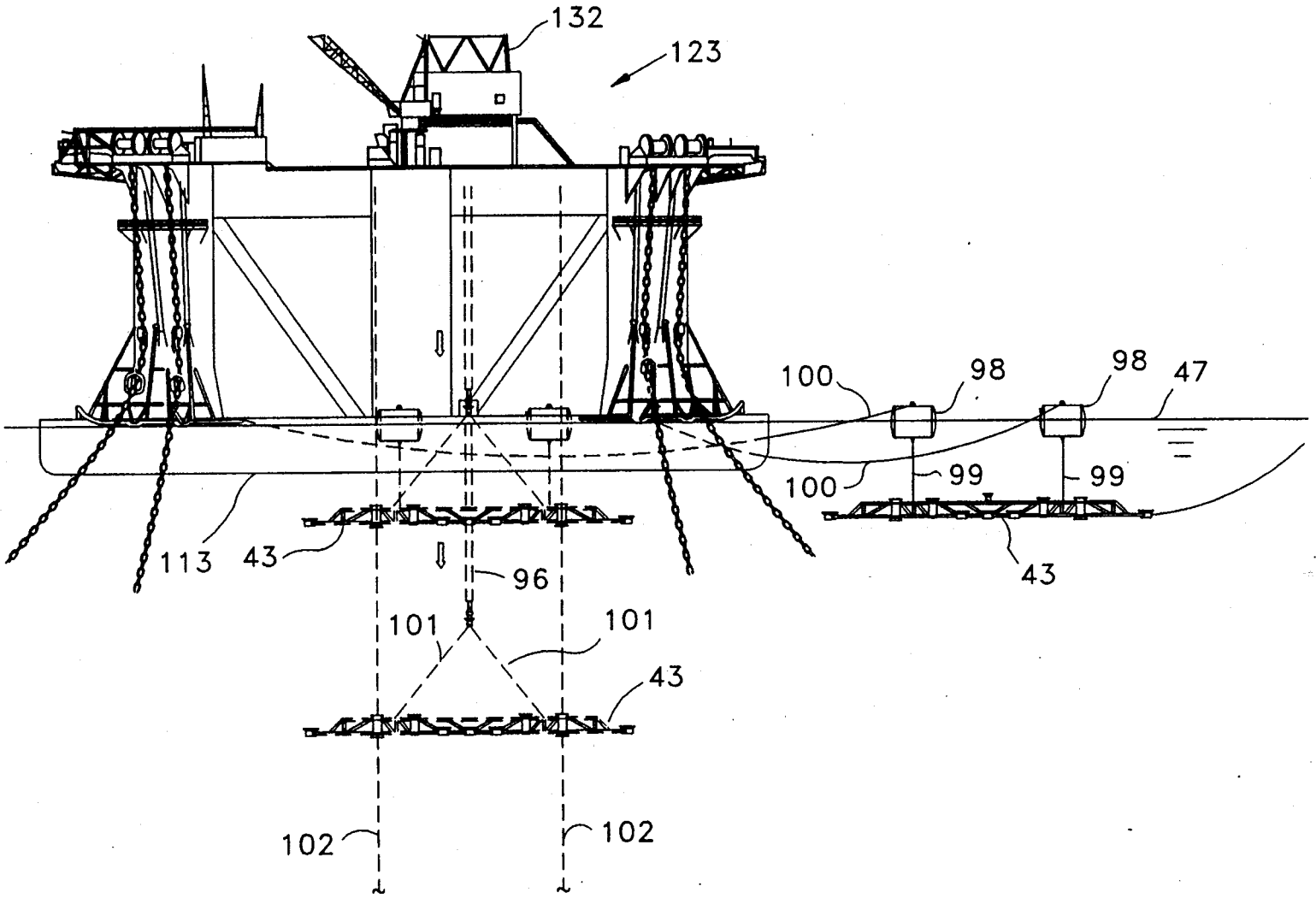
FIG. 17 illustrates how the template structure, after release from the cargo barge, may be towed submerged and suspended from conventional flotation devices to the platform site and how the template structure may be positioned below the rig of a drilling vessel and connected to and suspended from the rig hoist, and then how the template may be lowered from the rig, by assembly of a riser pipe until the template structure is emplaced on the seabed surface or in the case of using support piles, is placed over and onto the support piles.

The seabed template structure 43 is loaded out and secured under a typical small cargo barge 135 (FIGS. 16A and 16B). Suspension buoys 98 are secured on the barge deck with lines 99 pre-installed to the template 43. A waterdepth of 10 to 12 feet along the tow route is sufficient to avoid grounding of the greater waterdepth is available. After launching the buoys 98 into the water, the template 43 is released from the barge. As shown in FIG. 17, after maneuvering the barge clear, the template 43, suspended from the buoys 98, is towed to the site. The template release from the barge may also be performed at the site. Maneuvering lines 100 are connected from the SSDV 123, which is deballasted up onto its hull pontoons 113. The template 43 is then floated under the vessel and the riser 96 connected to lowering slings 101, pre-installed on the template. Guidelines 102 are used to lower and engage the add-on cans 121 onto the pin piles 44 (FIG. 15C). After taking up the template payload on the riser 96, the buoys 98 are released and pulled clear. Assembling the riser string 96, the template 43 is lowered down the guidelines 102 and landed out over and onto the support pin piles 44.

The template 43 is now ready for the production well drilling program to be commenced and for the installation of the foundation anchor piles 45.

Foundation Anchor Piles And Tendons

Figure 18A:
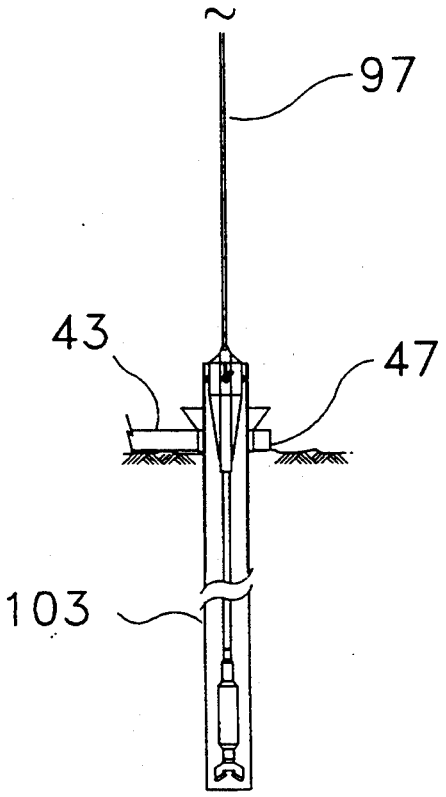
FIGS. 18A and 18B illustrate a method by which a drilling rig may lower from the surface to the seabed and then, by jetting procedures install a foundation pile casing/liner, and then how the rig may drill a hole down beyond the lower extremity of the casing.
Figure 18B:
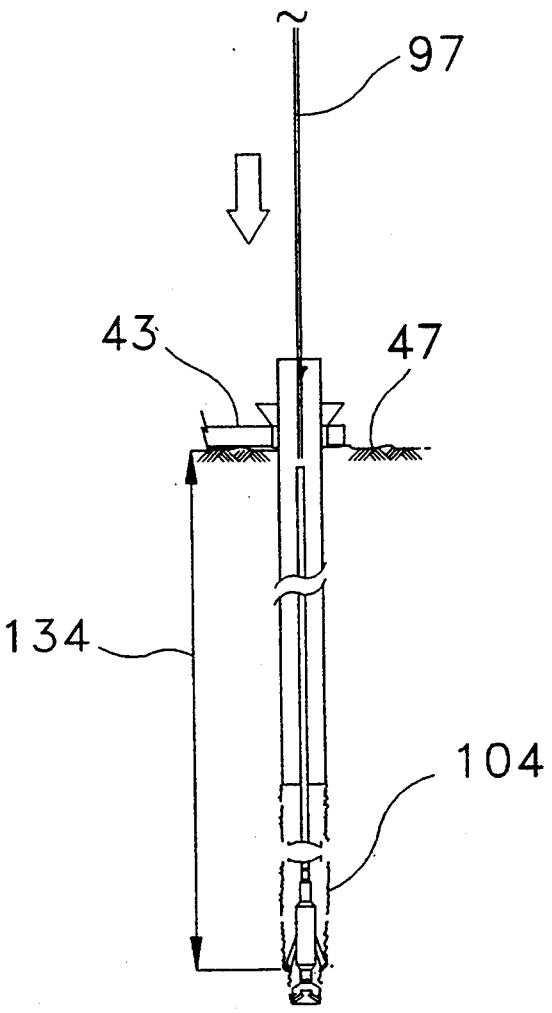

On completion of well drilling activities, or as previously mentioned when desired, the platform anchor piles 45 and tendons 46 are installed in two stages, illustrated schematically in FIGS. 18A and 18B.

Figures 19A, 19B, 19C:
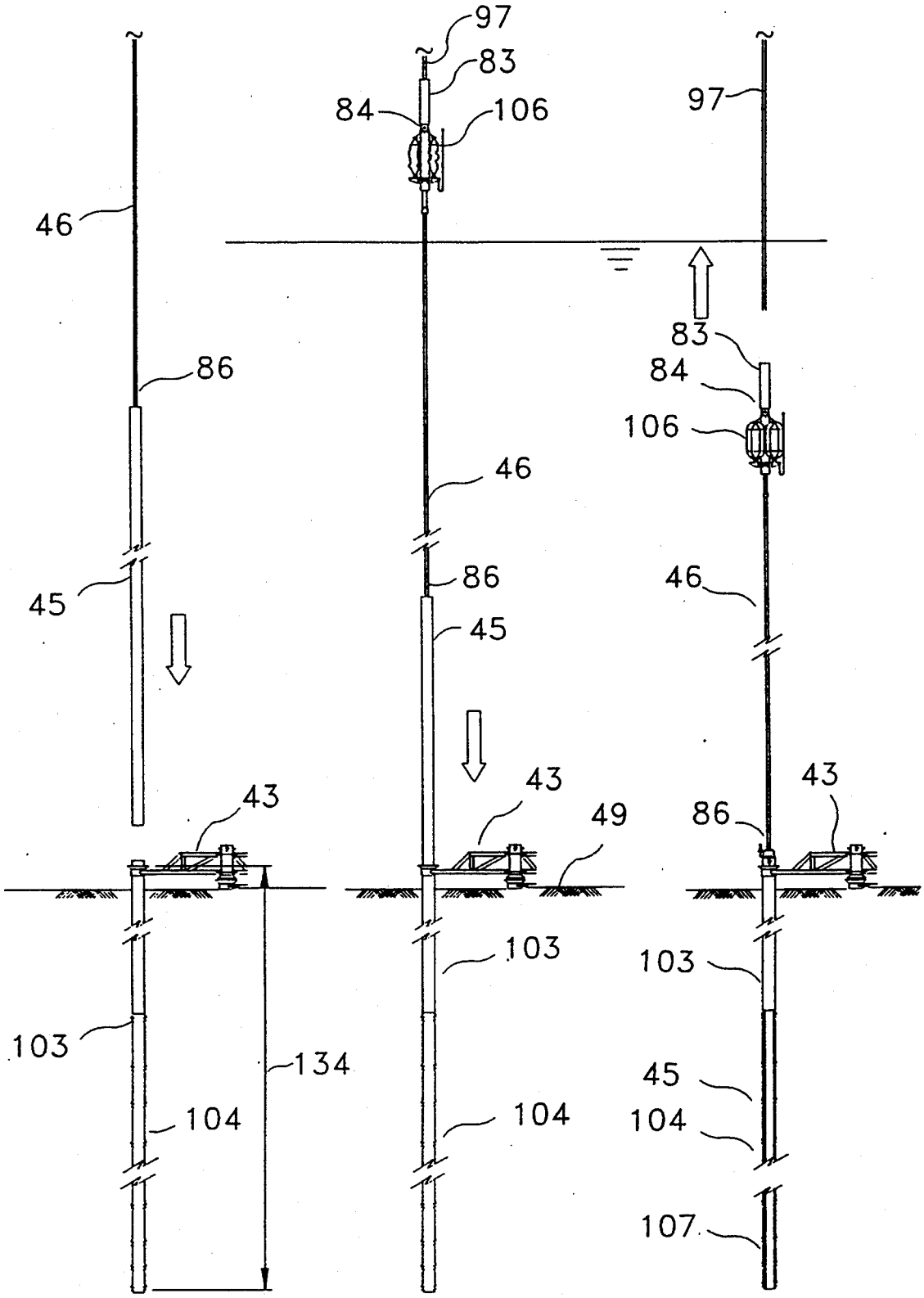
FIGS. 19A, 19B, and 19C illustrate schematically the stages of the installation of a foundation pile/tendon assembly using a drilling vessel including: assembly of the foundation pile sections to form a complete pile and connection of the tendon lower extremity to the top of the foundation pile and assembly of sections of tendon to form a length of tendon, lowering the foundation pile towards the subsea template and through the desired template guide receptacle into the foundation pile casing/liner and bored hole, completion of the tendon assembly, connection of top connector pipe, attachment of temporary buoyancy means; and further lowering and then rotation of the rig drill string from which the tendon is suspended, to engage and secure the foundation pile to the installed casing and inflation of the temporary buoyancy means thus supporting the tendon and permitting disconnection of the rig suspension drill string.

The casings 103 for all the piles are first run on the drillstring 97, jetted in to the required penetration (FIG. 18A) and the holes 104 for the piles drilled to the desired depth 134 (FIG. 18B). Each pile 45 and tendon 46 is deployed as an assembly, run down guidelines and stabbed into the installed casing 103 (FIG. run down guidelines and stabbed into the installed casing 103 (FIG. 19A). The anchor pile has a temporary J-slot connection 105 (FIG. 10) to the top of the casing pipe 103. After this is engaged (FIG. 19B), the tendon temporary buoyancy assembly 106 is inflated so that the tendon is free-standing and the drillstring 97 can be released and recovered (FIG. 19C). When all tendons have been installed, the foundation piles 45 are grouted out 107.

Hull Connection

Figure 20:
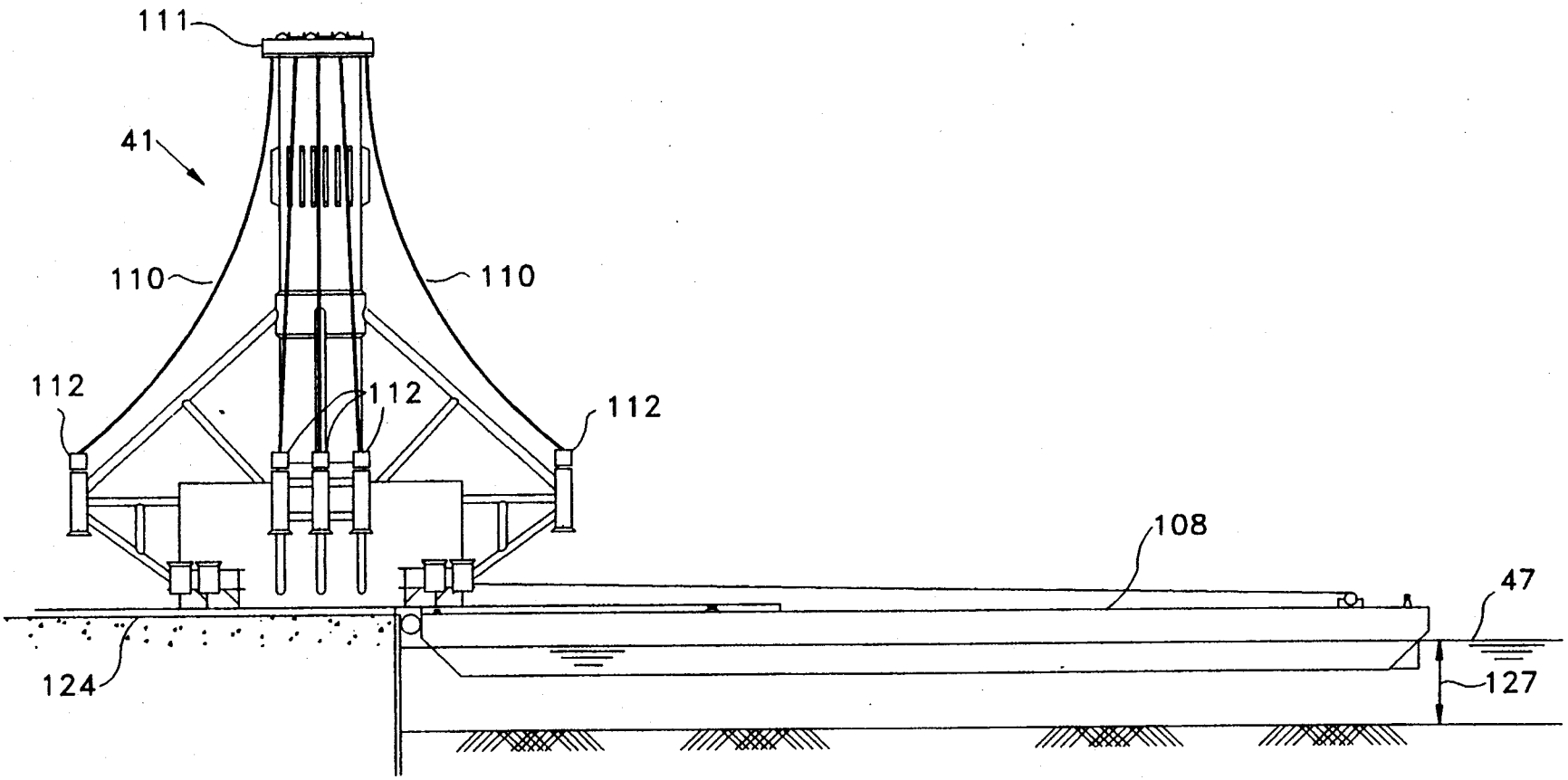
FIG. 20 is an elevational view illustrating a method of loading the complete platform hull from the location of its manufacture and assembly onto a transport barge.
Figure 21:
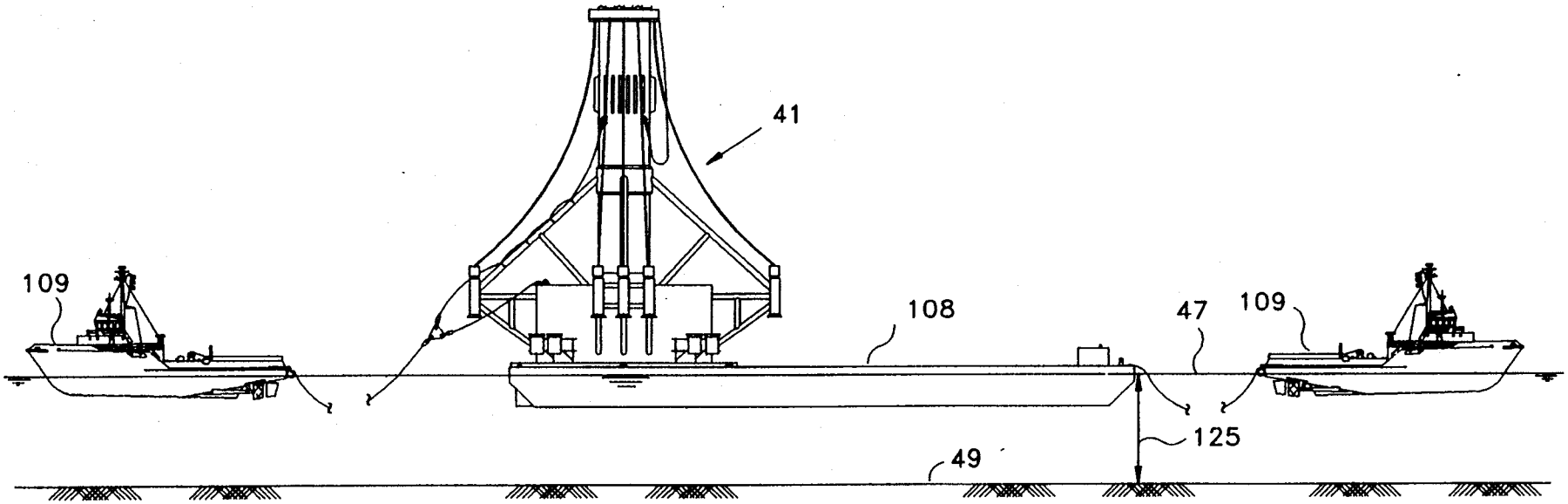
FIGS. 21, 22 and 23 are elevational views which illustrate a method of towing the platform hull on the transport barge, floating the hull off the barge, ballasting the hull to a desired stable draft and then towing the floating hull to the platform site.
Figure 22:
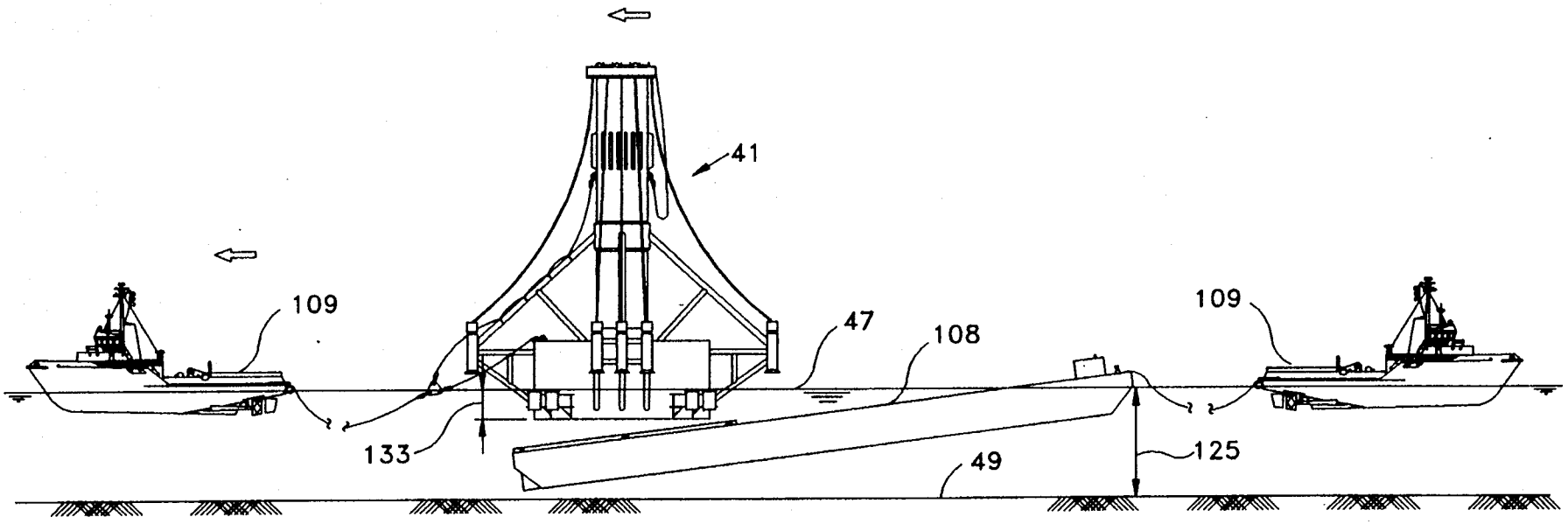
Figure 23:
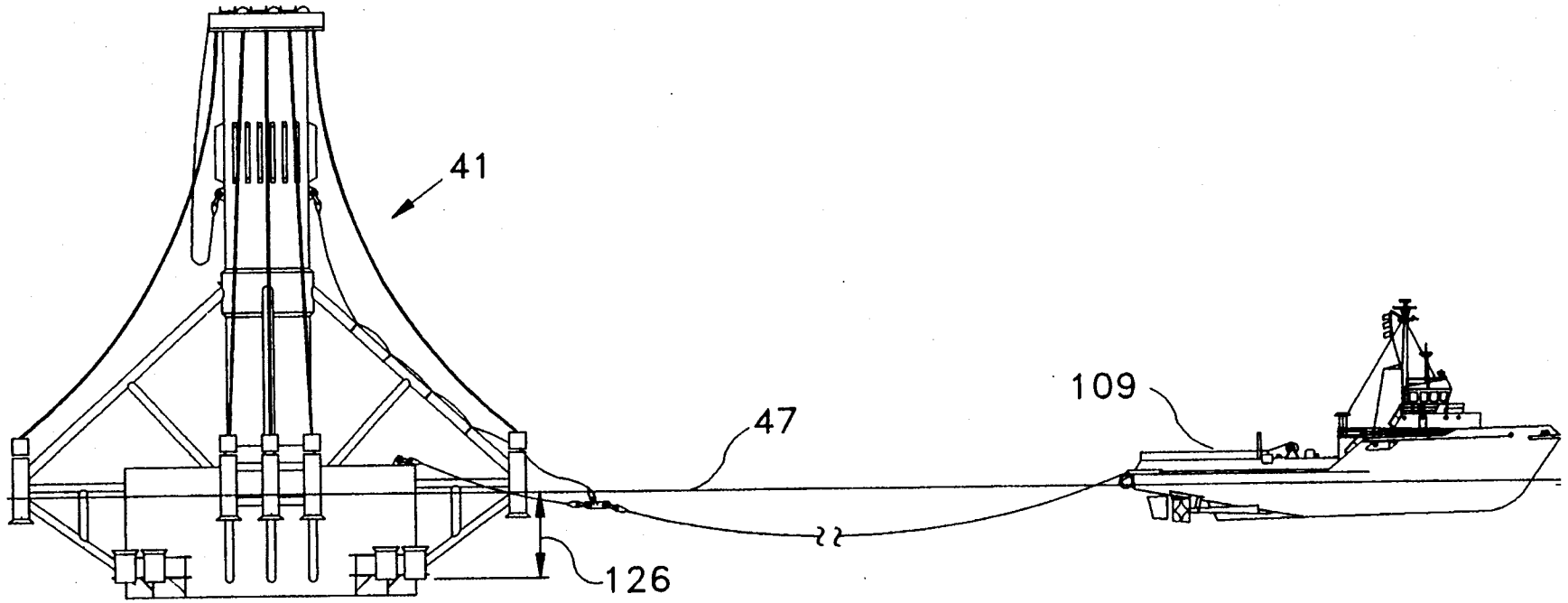

Recognizing waterdepth limitations at many offshore structures fabrication yards 124, the hull structure 41 is loaded onto a cargo barge 108 for the inland/inshore towage route where there may be insufficient waterdepth 127 to tow floating said hull structure (FIG. 20). When the tow arrives at a location with sufficient waterdepth 125, (FIG. 21) the barge is ballasted and trimmed until the hull can be floated off at minimum hull draft possible 133 (FIG. 22). After ballasting the hull to the desired draft 126, the tow proceeds to the site (FIG. 23).

Figure 24:
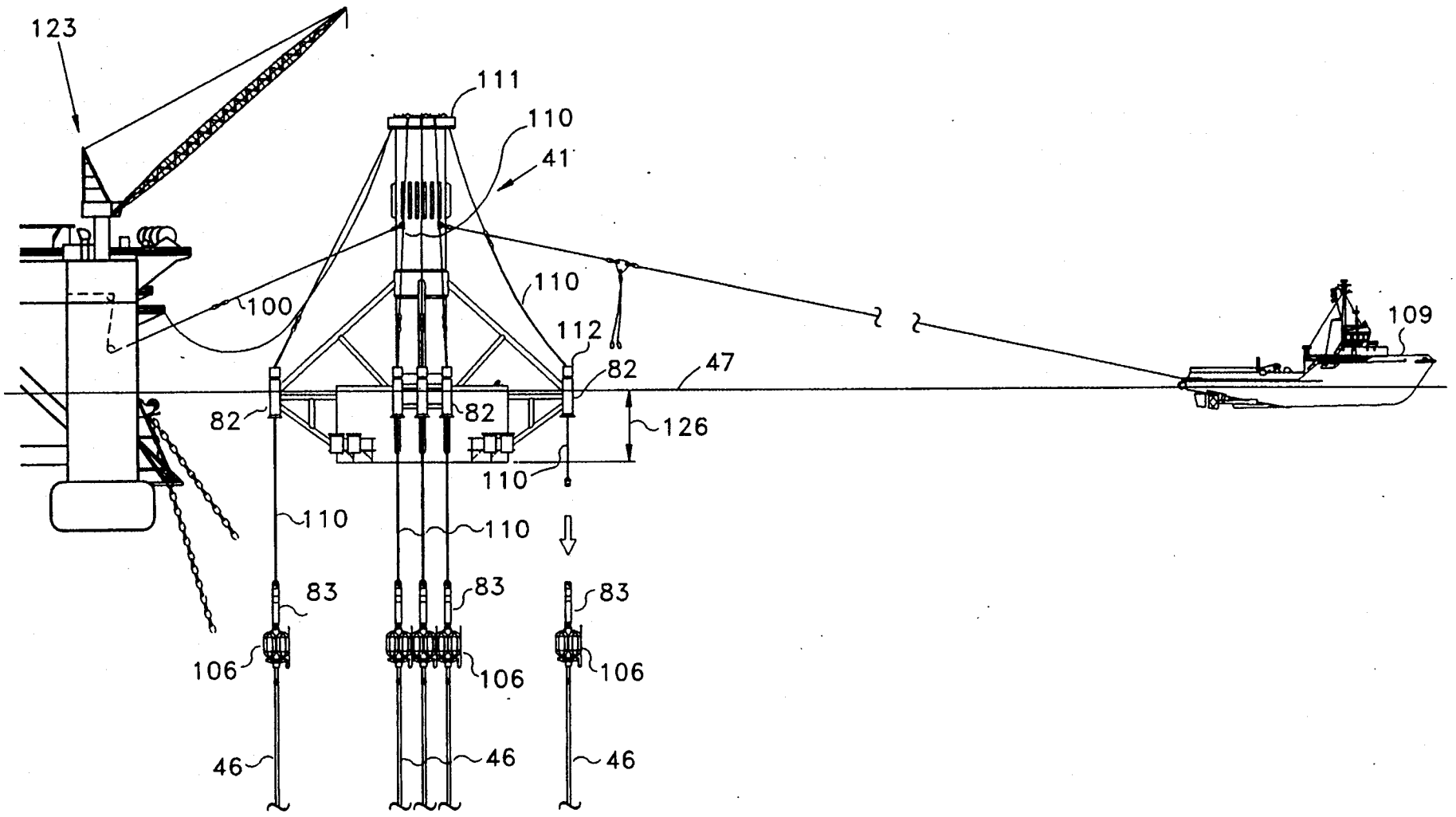
FIGS. 24 and 25 are an elevational view and a plan view, respectively, illustrating a method by which a drilling vessel, with assistance of tugboats, may position the platform hull over and directly above the installed and anchored tendons.
Figure 25:
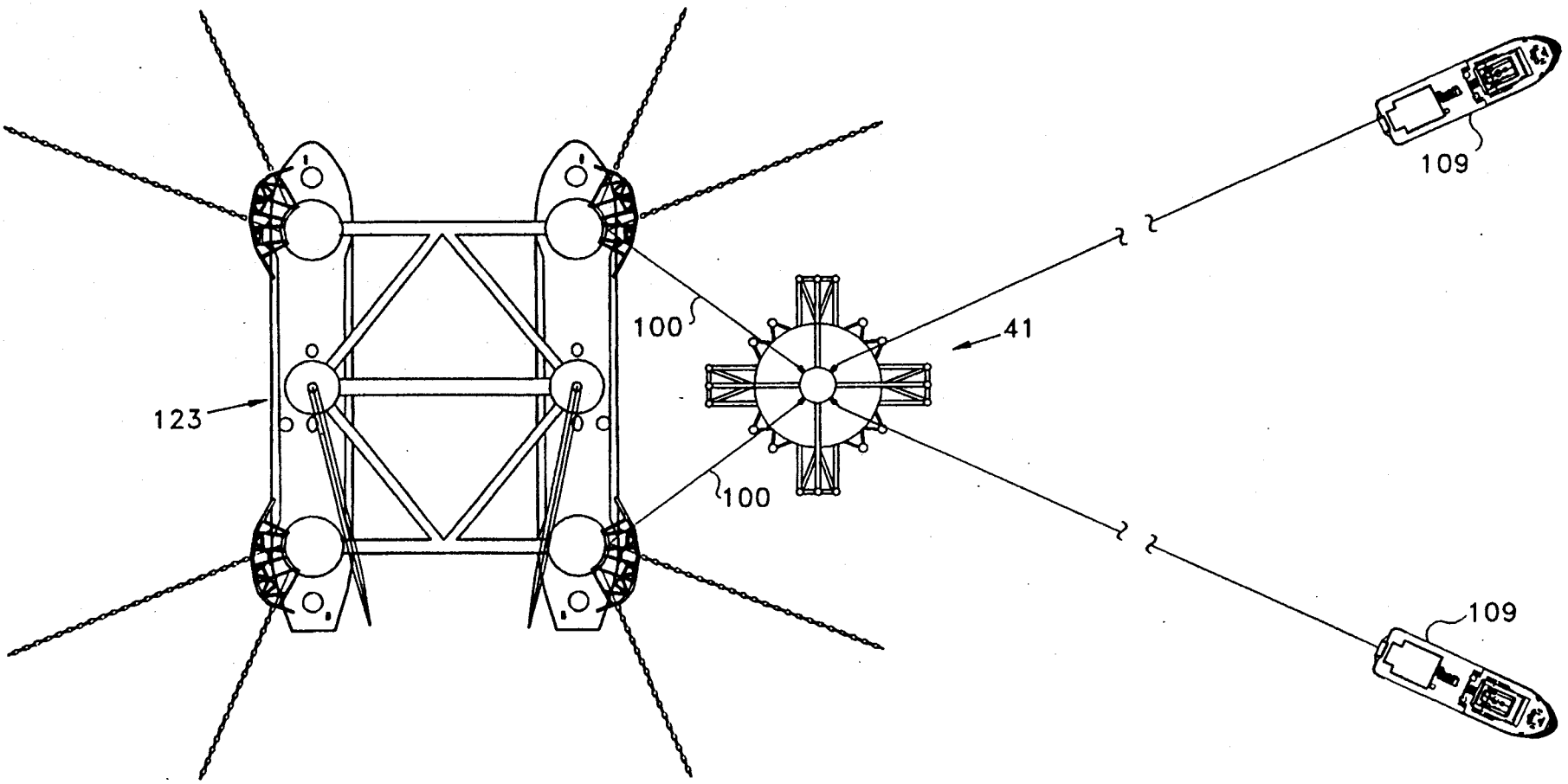
Figures 26A, 26B:
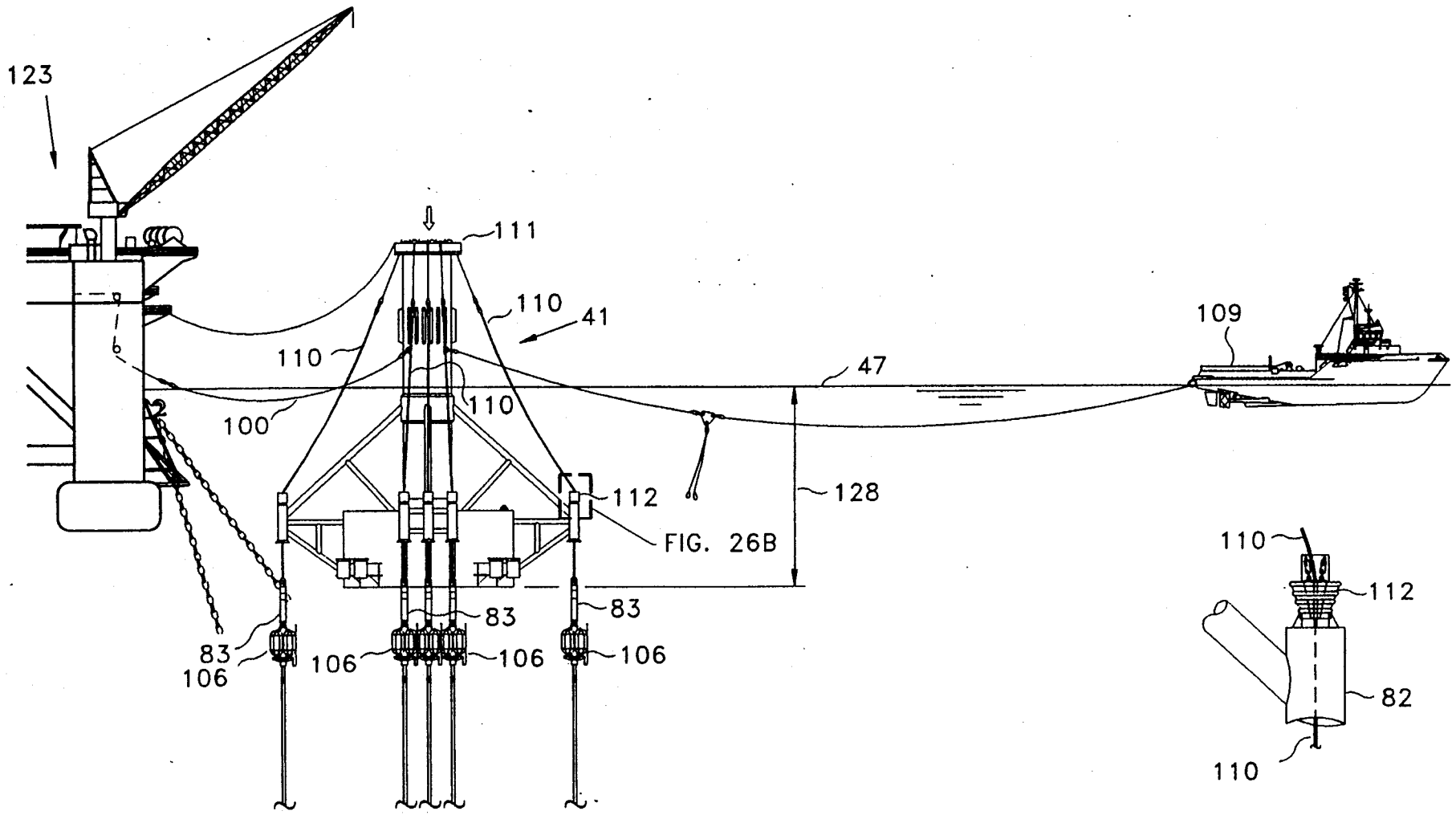
FIGS. 26A and 26B are elevational views illustrating a method by which the platform hull may be ballasted to increase its draft, and as the draft increases the installed tendons are aligned with and inserted into the connection sleeves of the hull and how the draft is increased until the hull is at a desired draft and then deballasted, and the hull is restrained from moving upward, and how the tendons are tensioned by the resulting deballasted hull desiring to move upward against the restraint of the anchored tendons.
Figure 27:
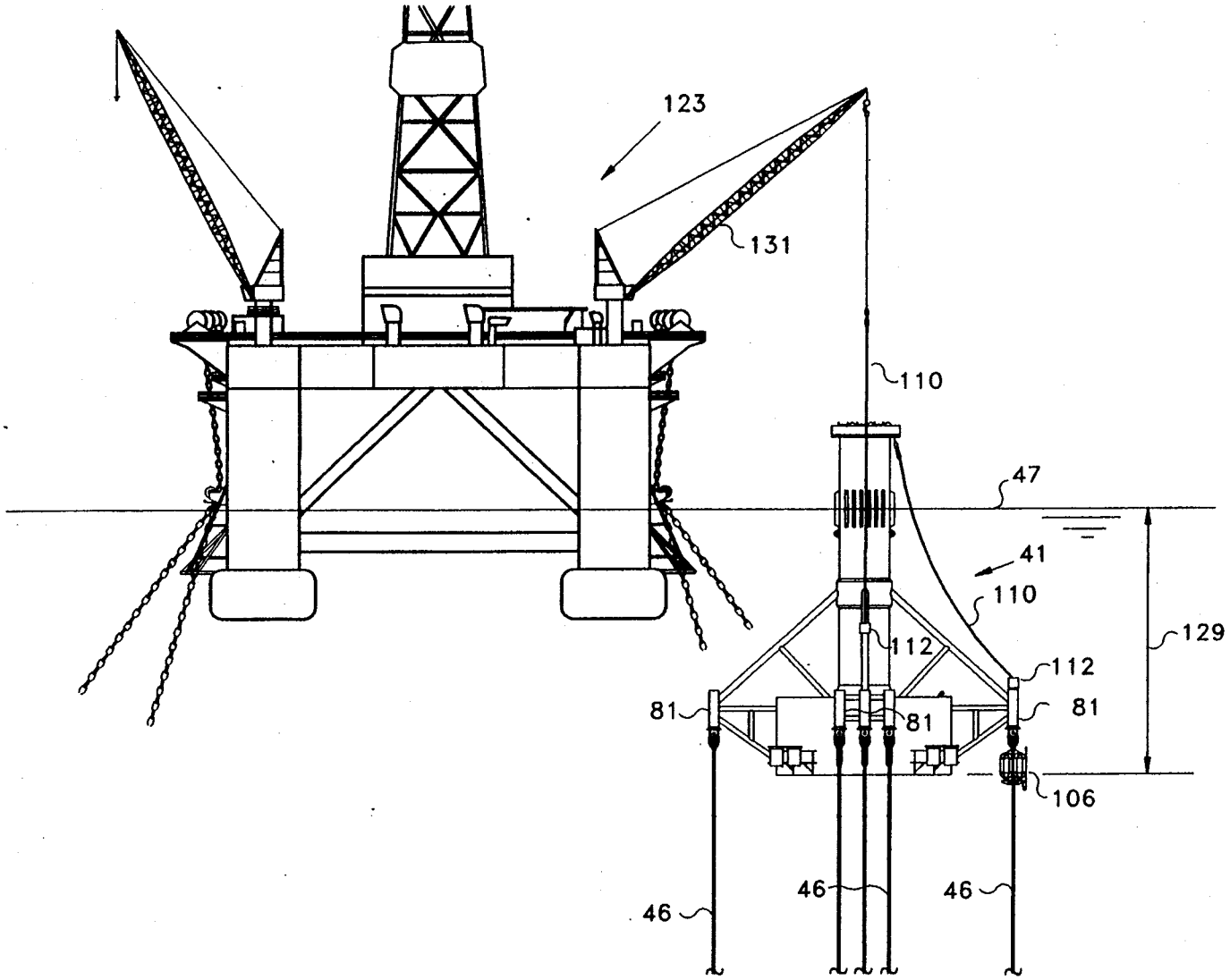
FIG. 27 is an elevational view of the installed platform hull after the top tendon connections have been grouted and illustrates the removal of the temporary hull installation equipment including the tendon auxiliary buoyancy means, the tendon tension lines, the tension line gripper units and the tension line winches and temporary supporting platform.

As shown in FIGS. 24 and 25, drilling vessel (SSDV) 123 control lines 100 and assist tugs 109 are used to maneuver and position the hull 41 over the tendons 46. The tension lines 110 are established from the tendons 46 through the connection sleeves 82 and up to a temporary winch deck 111 (FIG. 26A). The gripper units 112 are then activated and the hull ballasted down over the tendon top connectors 83. The grippers 112 allow the hull to rachet down the tension lines whilst preventing upward movements during the transitional increase in the hull draft 128 (FIG. 26A). When the hull 41 reaches the prescribed draft and horizontal trim 129 (FIG. 27), ballast is pumped out to pretension the tendons 46. Having locked off the hull 41, the permanent tendon top connections 81 are grouted 85 (FIG. 9). Having completed the hull connections, and using the SSDV platform crane 131, the temporary buoyancy assemblies 106 are deflated and removed as well as the tension lines 110, gripper units 112 and winch platform 111, and the SSDV 123 is then demobilized from the site (FIG. 27).

Topsides

Figure 28:
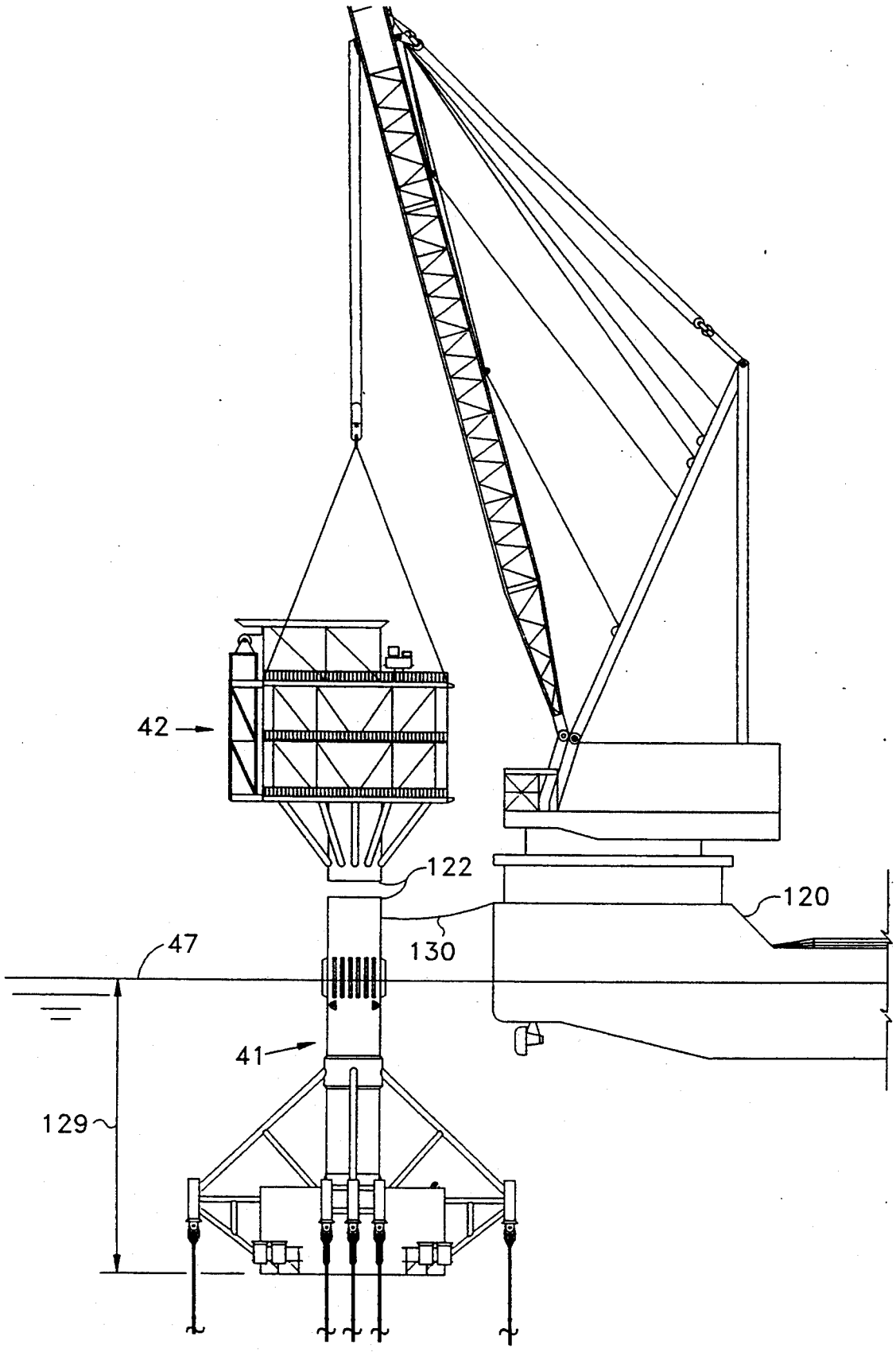
FIG. 28 is an elevational view of the installed platform hull and shows a method of how the platform deck may be lifted by a conventional cranevessel from a transport barge and may be placed upon the hull upper column and how the deck is thus permanently supported by the hull.
Figure 29A:
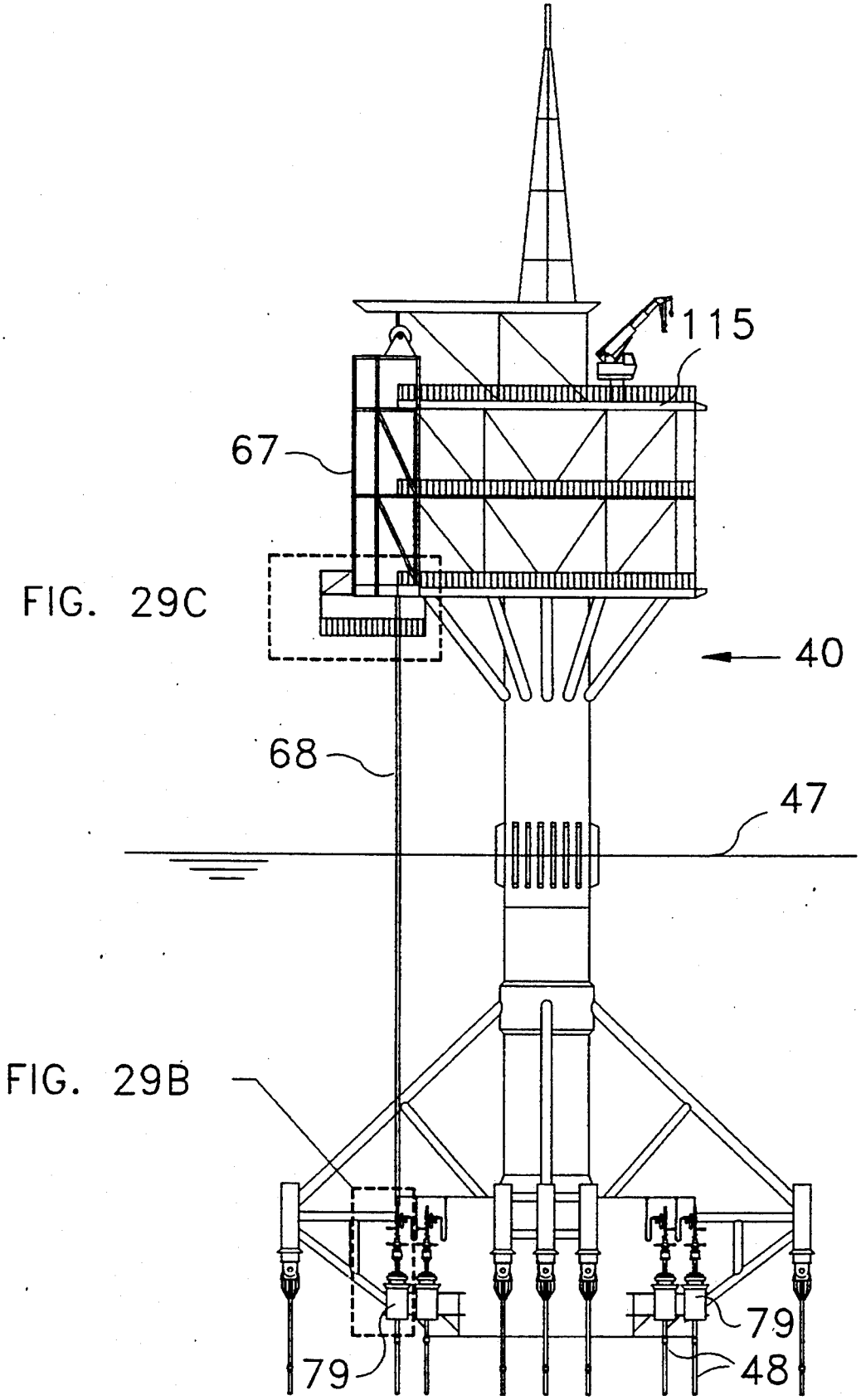
FIGS. 29A, 29B, and 29C are elevational side views of the completed installed platform and enlarged details illustrating the deck supported workover platform when connected to a desired well riser and tree and the workover platform being engaged in operations on the well during the production operations of the working platform.
Figure 29C:
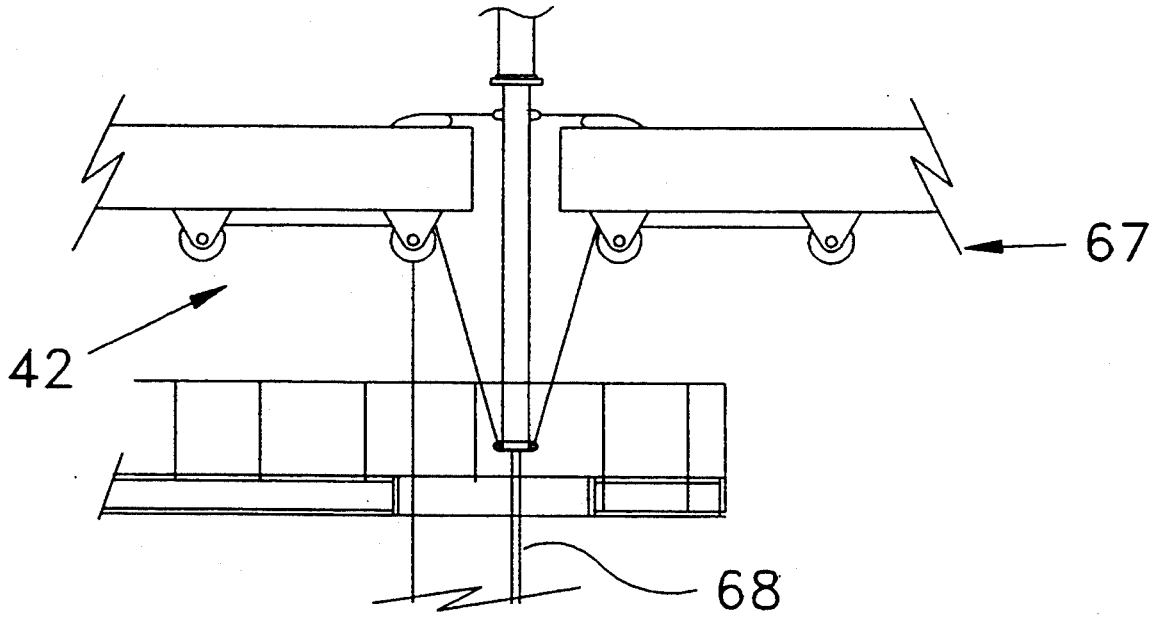
Figure 29B:
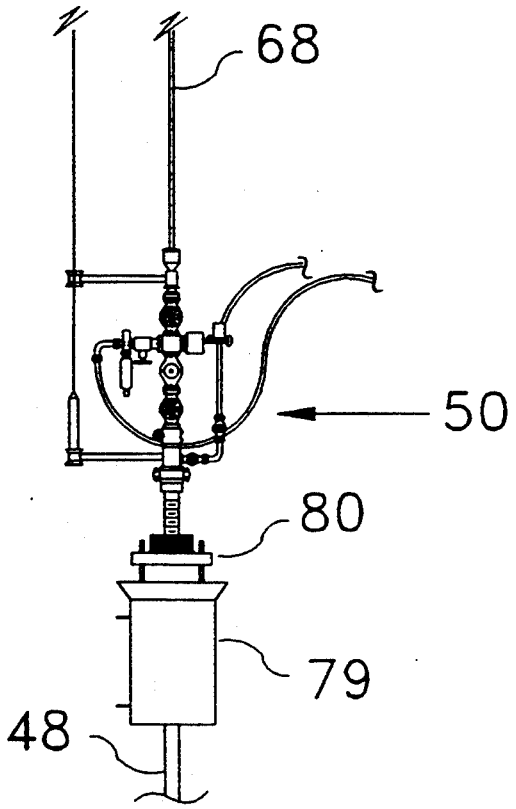

As shown in FIG. 28, a crane vessel 120 is required to install the integrated deck structure 42 complete with all production equipment and facilities. This topsides package is loaded out, transported on a barge and then lifted onto the hull using conventional procedures and the structural welded connection 122 of the deck structure 42 and the platform hull 41 is performed.

If available, a DP installation vessel is desirable; however, it is technically feasible to perform the topsides installation with a lift vessel moored 130 to the hull structure and with assisting tugboats.

Risers and Completion

Referring now to FIGS. 29A, 29B, 29C, and 8, the mobile workover rig 67 is used to run and tie back the production risers 48 and the christmas trees 50 and set same on the hull supports 79. The method comprises for each well riser 48 the lifting by the deck crane 42 of riser pipe sections from a transport vessel means onto the deck upper level 115 and then the stacking of the riser sections vertically in the workover platform 67, which is positioned above a desired riser support 79 and then the workover platform is used to connect the riser sections and deploy vertically the assembled riser string down and through the support 79 until the riser is completely assembled, with riser tension adjuster 80 (FIG. 8) installed on the riser 48 and with christmas tree 50 connected at its upper extremity. The complete production riser assembly is then lowered suspended from the workover platform 67 by an additional length of riser pipe and the lower extremity of the well riser 48 is connected remotely to the wellhead 50, near the seabed, using conventional drilling practices and procedures. As best seen in FIG. 8, the threaded nut 119 of the tension adjuster 80 is then rotated until it is positioned at the desired elevation with respect to the support 79 and the tie rod threaded nuts 118A are advanced up the tie rods 118 until the riser tensioner 80 bears fully against the nut 119; the whole production riser is thus supported by the support 79 with a desired pretension load which is imparted by the tensioner 80 acting against the nut 119. All of the foregoing operations are repeated to install each of the production risers.

Figure 30:
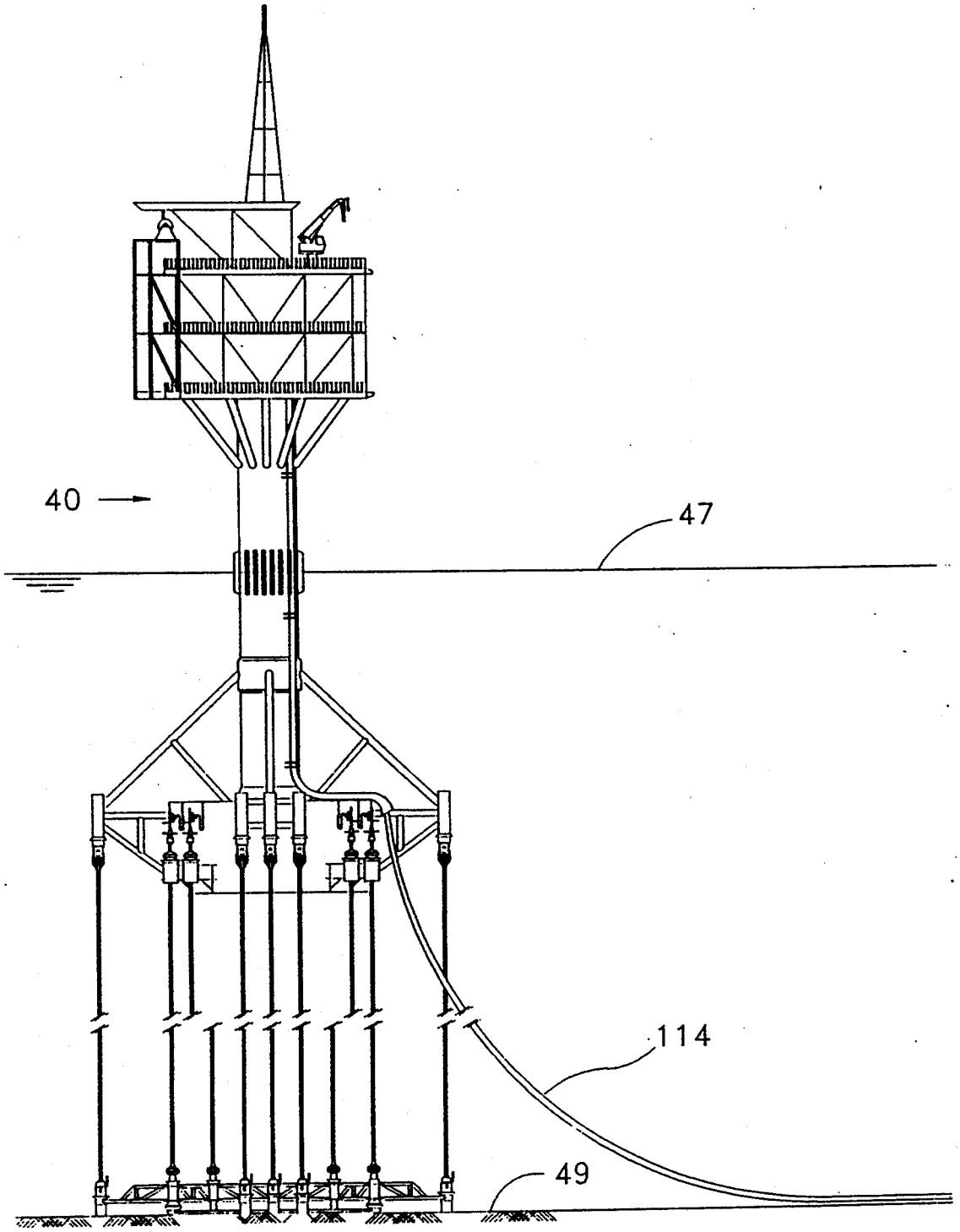
FIG. 30 is a side elevational view of the platform with a pipeline connected to it and through which, platform products may be exported.

The platform 40 is then completely ready to initiate production operations and bring the field onstream, once an offtake tanker barge 69 has been mobilized to site, moored up and connected to the platform (FIG. 7), or when a pipeline 114 has been connected to the platform (FIG. 30).

Figure 31:
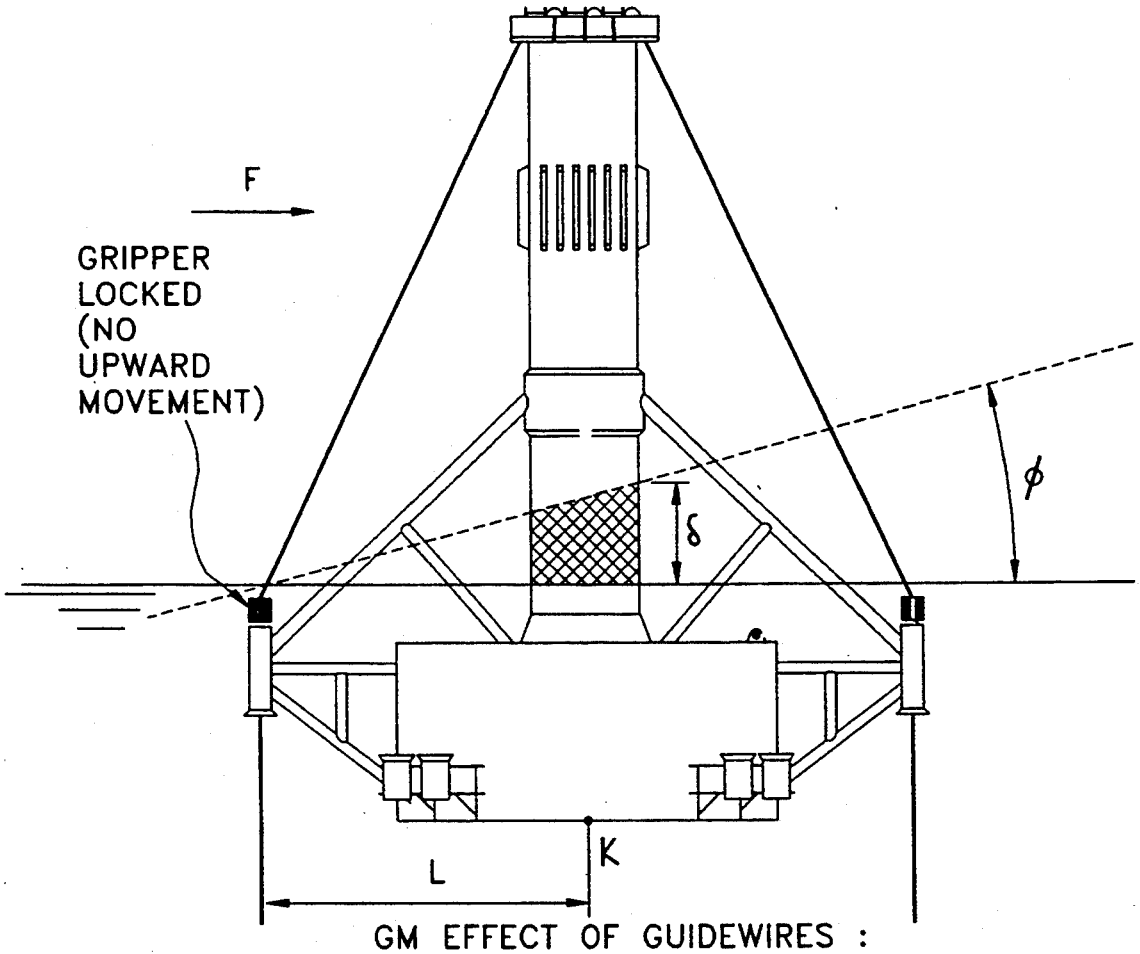
FIG. 31 is an elevational view of the completed platform illustrating schematically the stabilizing moment acting upon the hull.

It is an advantage to use tensioning lines connected to each of the tendons during the installation of the platform hull to enhance the hydrodynamic stability of the hull during the phase when it is ballasted down and in particular the transition from large waterplane to small waterplane may cause the hull to be unstable without the tensioning lines, which by only impeding upward movement of the hull, do enhance the stability of the hull by causing a stabilizing moment to act upon the hull. The stabilizing moment being equal to:

$$M = P_w g R^2 A_{wp} \sin \phi$$

where:

$\phi$=angle of inclination
R=radius from tendon to center of hull
$P_w$=seawater density
g=acceleration due to gravity
$A_{wp}$=waterplane area
and further illustrated in FIG. 31.

After reading and understanding the foregoing description of the invention, in conjunction with the drawings, it will be appreciated that several distinct advantages of the subject platform and method of towing transportation and installation. It will further be appreciated that the invention incorporates and combines novel ideas with existing practices and technology which are applied, in the context of the invention, in a new manner.

Without attempting to set forth all the desirable features of the instant tension leg platform, at least some of the major advantages of the invention include the unique circular deck with mobile workover rig which may be positioned at any location around the deck perimeter, the hull configuration which is buoyant and stable during all stages of installation yet at the same time presents minimum resistance to wave and current loadings, and minimizes the tendon tension loads and load variations.

Additionally, support of the risers at the base of the hull instead of at the deck level reduces the platform payload size and tendon anchor loadings, and furthermore permits the use of a riser support means. By minimizing the weight of the deck and hull using the foregoing means, the magnitude of the hull anchoring forces is correspondingly minimized, and consequently the size and weight and quantity of the tendons, and anchor foundation piles is reduced.

Furthermore, the seabed template structure positions but does not support the installed anchor piles and production wells and its structural strength and weight is thus minimized.

It is an advantage that the tendons may be manufactured using conventional drilling industry materials and components in sections transported to site by a supply boat and assembled to form a whole tendon and installed by a conventional deepwater drilling vessel. Furthermore, it is an advantage that the lower extremity may be connected directly with no moving parts to the anchor pile and that the upper extremity of the tendon may be attached by a cardan joint to a length of steel pipe which may be connected using cement grout to a hull sleeve pipe, and with no need for other means of adjusting the lengths of the tendons.

A further advantage of the invention is that an anchor pile may be connected to the tendon and the whole assembly deployed and installed by a deepwater drilling vessel.

Yet another advantage is that all the tendons may be connected to the foundations and that the hull may then be connected simultaneously to the tendons and that there is no requirement to adjust the tension loads in the tendons, the tension in each tendon being assured equal within limitations by the attachment to each tendon of temporary buoyancy devices of equal size and weight.

It is an advantage that the deck may be lifted and installed as a single unit by a conventional cranevessel and that the cranevessel does not need to be moored by anchor mooring lines nor be equipped with a dynamic positioning system but may be moored to the hull and additionally controlled by tugboats.

A further advantage of the invention is that fluid products from the platform as well as being exported through a conventional pipeline may alternatively be exported to a tanker which may be moored to the platform.

In describing the invention, reference has been made to preferred embodiments and illustrative advantages of the invention. Those skilled in the art, however, and familiar with the instant disclosure of the subject invention may recognize additions, deletions, modifications, substitutions and/or other changes which fall within the purview of the subject invention and claims.

What is claimed is:

1. An offshore tension leg platform comprising:

(a) a hull having a bottom portion and an upper portion including a slender column adapted at its upper end to receive and support deck means and after said deck means is supported thereon, said column being disposed partially above the surface of the water and partially below, and said hull having a plurality of internal ballast/buoyancy compartments for varying its buoyancy such that it may be towed floating to the installation site, ballasted in stages until tendons are connected thereto, then deballasted until it has a predetermined installed draft;

(b) structural support elements connected with said hull extending a predetermined distance outwardly therefrom and having vertical-entry tendon connection sleeves at their outer ends which are positioned in laterally outward spaced relation to said hull a predetermined distance and each having an open bottom end to receive the upper end of a tubular tendon;

(c) a plurality of elongate tubular tendons each of which is connected at a lower end to a foundation pile on the seabed and having an upper end vertically received within said tendon connection sleeves by lowering said hull by ballasting and thereafter connected to said tendon connection sleeves, said tendons disposed in outwardly spaced relation to said hull means a predetermined distance sufficient to reduce loadings in said tendons caused by horizontal loadings imposed on said platform; and (d) deck means supported at the upper end of said slender column for supporting well production equipment and well workover equipment.

2. An offshore tension leg platform as defined in claim 1 wherein said hull means has a plurality of said slender columns adapted at their upper ends to receive and support said deck means.

3. An offshore tension leg platform as defined in claim 1 further comprising:

well riser support means disposed near the bottom portion of said hull for supporting well risers and well trees beneath the water surface at an elevation near that of said tendon connection sleeves;

said well riser support means having riser tensioning means for receiving the upper end of a riser supported thereby and maintaining tension in the supported riser nearly constant while accommodating variations of the effective length of the risers, such that the length of said well risers are approximately the same as the length of said tendons and effective length variations of the supported risers is reduced when the draft of said hull changes due to setdown.

4. An offshore tension leg platform as defined in claim 1 wherein said hull upper portion and bottom portion are of polygonal plan configuration, and said deck means has a polygonal plan configuration.

5. An offshore tension leg platform as described in claim 1 further comprising:

adjustable tendon tensioning means above the top of each said tendon connection sleeve connected with the upper end of each said tendon for adjusting the length of each of said tendons to be of equal overall length; and and grouting means connected with each said tendon connection sleeve for securing the upper ends of each said tendon to said tendon connection sleeve by cement grouting.

6. An offshore tension leg platform as defined in claim 1 further comprising:

tendon articulation and disconnection means connected beneath the upper end of each said tendon and disposed below the bottom ends of said tendon connection sleeves for allowing said tendons to articulate in any direction with respect to said hull and for allowing said tendons to be disconnected from said tendon connection sleeves after being connected thereto.

7. An offshore tension leg platform as defined in claim 6 wherein said tendon articulation and disconnection means is a cardan joint connected beneath the upper end of each said tendon and having a removable link pin for disconnecting said tendons from their upper ends.

8. An offshore tension leg platform as defined in claim 1 wherein each of said elongate tubular tendons has a stress joint at at least one end.

9. An offshore tension leg platform as defined in claim 1 wherein each of said tendons is of sufficient weight and dimension to provide a net buoyancy and are installed and connected at their lower end to a foundation pile on the seabed without requiring auxiliary buoyancy elements.

10. An offshore tension leg platform as defined in claim 1 further comprising:

production equipment and facilities on said deck means for performing well production operations and including mooring means for mooring a tanker to said platform and product export hose means for pumping fluid products into the tanker for export from the platform site, and said platform is connected by well risers to the trees of wells which wells are located in laterally spaced relation to the position of said platform for performing well production operations.

11. An offshore tension leg platform as defined in claim 1 further comprising:

well workover equipment and facilities on said deck means for performing well workover operations including wireline workovers, coil tubing workovers, fluid and chemical injection, removal and reinsertion of tubing, downhole recompletion and well logging, and said platform is connected by well risers to wells for performing well workover operations on said wells.

12. An offshore tension leg platform as defined in claim 1 further comprising:

production equipment and facilities on said deck means for performing well production operations and including mooring means for mooring a tanker to said platform and product export hose means for pumping fluid products into the tanker for export from the platform site, and well workover equipment and facilities on said deck means for performing well workover operations including wireline workovers, coil tubing workovers, fluid and chemical injection, removal and reinsertion of tubing, downhole recompletion and well logging, said platform is connected by well risers to the trees of wells which wells are located in laterally spaced relation to the position of said platform for performing well production operations, and said platform is connected by well risers to wells disposed on the seabed for performing well workover operations on said wells.

13. An offshore tension leg platform as defined in claim 1 further comprising:

tensioning lines connected between said hull and the upper end of each of said tendon to impart a moment arm about the center of said platform to inhance the hydrodynamic stability of said hull during the phase of ballasting to increase the draft of said hull from a first towage draft position to a final draft position to prevent said hull from overturning or capsizing during said phase of ballasting to increase the draft of said hull.

14. An offshore tension leg platform as defined in claim 1 wherein;

said hull bottom portion and said slender column are dimensioned relative to one another such that the area of said column relative to the area of said bottom portion whereby the vertical force acting upon said hull is minimized at a particular desired wave frequency determined by setting the integral of the dynamic pressure due to said wave, integrated over the projected horizontal area of said column plus the added mass force due to the projected horizontal surface of said column equal to the integral of the dynamic pressure on said bottom portion over the bottom surface area, plus the added mass force due to said projected horizontal area of said bottom portion.

15. An offshore tension leg platform as defined in claim 1 further comprising:

temporary wire gripper and dampening means removably connected with each said tendon connection sleeve; and winch means on said platform hull having a tensioning wire passing through said wire gripper and dampening means, said tendon connection sleeves, and releasably connected with the upper portion of each of said tendons, said wire gripper and dampening means permitting upward travel of said tensioning wire through said tendon connection sleeve but preventing downward movement of said tensioning wire relative to said tendon connection means, said winch means in operation applying nominal tension in said tensioning wires while said hull is progressively ballasted; and said wire gripper and dampener means allowing said tensioning wires to travel upward through said tendon connection sleeves but preventing downward movement therethrough to progressively dampen and reduce vertical heaving motions of said hull until all such motions relative to said tendons have been arrested and said hull is at a desired draft.

* * * * *